US007637418B2

(12) United States Patent
Craig

(10) Patent No.: US 7,637,418 B2
(45) Date of Patent: Dec. 29, 2009

(54) ADVANCED GESTATIONAL WHEEL CALCULATOR

(76) Inventor: H. Randall Craig, 3200 N. Dobson Rd., Suite F7, Chandler, AZ (US) 85224

( * ) Notice: Subject to any disclaimer, the term of this patent is extended or adjusted under 35 U.S.C. 154(b) by 306 days.

(21) Appl. No.: 10/553,593

(22) PCT Filed: Oct. 28, 2004

(86) PCT No.: PCT/IB2004/052224

§ 371 (c)(1),
(2), (4) Date: Oct. 18, 2005

(87) PCT Pub. No.: WO2005/039378

PCT Pub. Date: May 6, 2005

(65) Prior Publication Data

US 2006/0208055 A1 Sep. 21, 2006

Related U.S. Application Data

(60) Provisional application No. 60/515,222, filed on Oct. 28, 2003.

(51) Int. Cl.
*G06C 3/00* (2006.01)

(52) U.S. Cl. ..... 235/88 RC; 235/78 R; 235/78 RC; 235/85 FC; 235/116

(58) Field of Classification Search ..... 235/88 RC, 235/78 R, 78 RC, 85 FC, 116; 40/111, 113, 40/114, 115, 595
See application file for complete search history.

(56) References Cited

U.S. PATENT DOCUMENTS 2,418,207 A 4/1947 Tilbrook (Continued)

FOREIGN PATENT DOCUMENTS

FR 2617618 1/1989

(Continued)

OTHER PUBLICATIONS

Colorado Department of Health, Best Practices Inadequate Maternal Weight gain, http://www.cdphe.state.co.us/ps/bestpractices/topicsubpages/inadequateweightgain.html, Nov. 20, 2003.

(Continued)

*Primary Examiner*—Karl D. Frech
(74) *Attorney, Agent, or Firm*—Oppedahl Patent Law Firm LLC

(57) ABSTRACT

The gestational wheel calculator of the current invention greatly extends the function and usefulness of the basic gestational calculation wheel by providing increased accuracy of gestational dates by using an average cycle length adjuster, provides paternity information using a sperm exposure marker, provides more accurate ultrasound and other test measurements by using scales printed parallel to gestational age, and provide a means of accurately aligning these measurements with the proper calendar or gestational date by including a transparent marker arm. In addition, normal range and error functions are included on the marker arm. A one-fourth year window is used to increase the surface area of information available for viewing charts, tables, and promotions on the underlying base plate. Easier reading of the calculator is provided by special markers for the first day of each calendar month and by providing sub-marks for each day within a gestational week. Scheduling conflicts are improved by providing a weekday scale covering the entire nine month duration of pregnancy. The other side of the gestational wheel can be used to provide additional promotional or informational items including rotating transparent windows to display additional surface area, to provide means of calculating algorithm solutions for body mass index, and display observational data for EFW, delta OD 450, and AFI.

31 Claims, 30 Drawing Sheets

U.S. PATENT DOCUMENTS

| | | | | |
|---|---|---|---|---|
| 2,727,686 | A | 12/1955 | Thalmann | |
| 2,808,206 | A | 10/1957 | Gomez-Rodriguez | |
| 3,278,118 | A | 10/1966 | Klein, Jr. | |
| 3,279,696 | A | 1/1967 | Sherman | |
| 3,486,691 | A | 12/1969 | Rodriguez | |
| 3,771,716 | A | 11/1973 | Sanchez | |
| 4,041,628 | A | 8/1977 | Sasson | |
| 4,092,521 | A | 5/1978 | Weisshaar | |
| 4,308,678 | A | 1/1982 | Slobin | |
| 4,350,878 | A | 9/1982 | Schwarz et al. | |
| 4,410,797 | A | 10/1983 | Hatzold | |
| 4,625,099 | A | 11/1986 | Freedom | |
| 4,737,619 | A | 4/1988 | Freedom et al. | |
| 4,751,373 | A | 6/1988 | Ivey | |
| 4,752,674 | A | 6/1988 | Rosenwaks | |
| 5,058,084 | A | 10/1991 | Riesen | |
| 5,258,907 | A | 11/1993 | Macri | |
| 5,310,994 | A | 5/1994 | Thabet et al. | |
| 5,496,070 | A | 3/1996 | Thompson | |
| 5,605,155 | A | 2/1997 | Chalana et al. | |
| 5,626,133 | A | 5/1997 | Johnson et al. | |
| 5,763,860 | A | 6/1998 | Denis et al. | |
| 5,772,584 | A | 6/1998 | Davies | |
| 5,777,905 | A | 7/1998 | Dowdle et al. | |
| 5,834,317 | A | 11/1998 | Davies | |
| 5,837,197 | A | 11/1998 | Porrazzo et al. | |
| 5,928,168 | A | 7/1999 | Laros, Jr. | |
| 6,375,616 | B1 | 4/2002 | Soferman et al. | |
| 6,600,696 | B1 | 7/2003 | Lynn | |
| 6,637,137 | B2 * | 10/2003 | Coster et al. | 40/113 |
| 6,789,728 | B1 * | 9/2004 | Muzzammel | 235/85 FC |
| 6,886,740 | B1 * | 5/2005 | Craig | 235/85 FC |
| 2003/0024974 | A1 | 2/2003 | Bromberg | |

FOREIGN PATENT DOCUMENTS

| | | |
|---|---|---|
| WO | WO 97/33214 | 9/1997 |
| WO | WO 01/36212 | 5/2001 |
| WO | WO 01/87157 | 11/2001 |

OTHER PUBLICATIONS

Grzybowski et al., Pregnancy Planning Guide, http://www.pregnancyplanningguide.com/about_pregnancy.cfm, Jan. 6, 2003.

Focus Information Technology, Pregnancy Wheel, http://www.obfocus.com/calculators/duedate.htm, Sep. 29, 2000.

Tekay, Pregnancy Wheel, http://www.fetalmedicine.ac.uk/gw/html/wheel.html, Jan. 13, 2002.

Division of Prevention and Intervention Services for Children and Youth Colorado Department of Public Health and Environment, Colorado Maternal and Child Health Block Grant Program Application, http://www.cdphe.state.co.us/ps/mch/mchgrant/03grantfiles/f03sectioniv.pdf, Jul. 15, 2002.

Perspective Enterprises, The BMI Wheel and The Gestation Wheel; http://www.perspectiveent.com/tools.html, Apr. 8, 2003.

American Slide Chart Corporation, Body Surface Area and Dosage Calculator, http://www.americanslidechart.com/solutions_detail.lasso?item=33123, Oct. 27, 2003.

Glaser, Conceiving & Ovulating Question http://www.cin.org/archives/cinnfp/10002/0005.html, Feb. 7, 2000.

The Young Mommies Help Site, Due Date Calculator, http://www.youngmommies.com/resources/duedate.html, Aug. 2003.

MicroSort Gender Selection Wheel, no date available.

ivpcare, Gestation Wheel & Pregnancy Management Time Table, no date available.

Alfigen Pregnancy Calculator and Chart, 1985.

Philips Gestational Age Calculator, 2003.

Grunebaum, Pregnancy Wheel & Ovulation Calendar, www.early-pregnancy-tests.com/wheel.html, 2005.

* cited by examiner

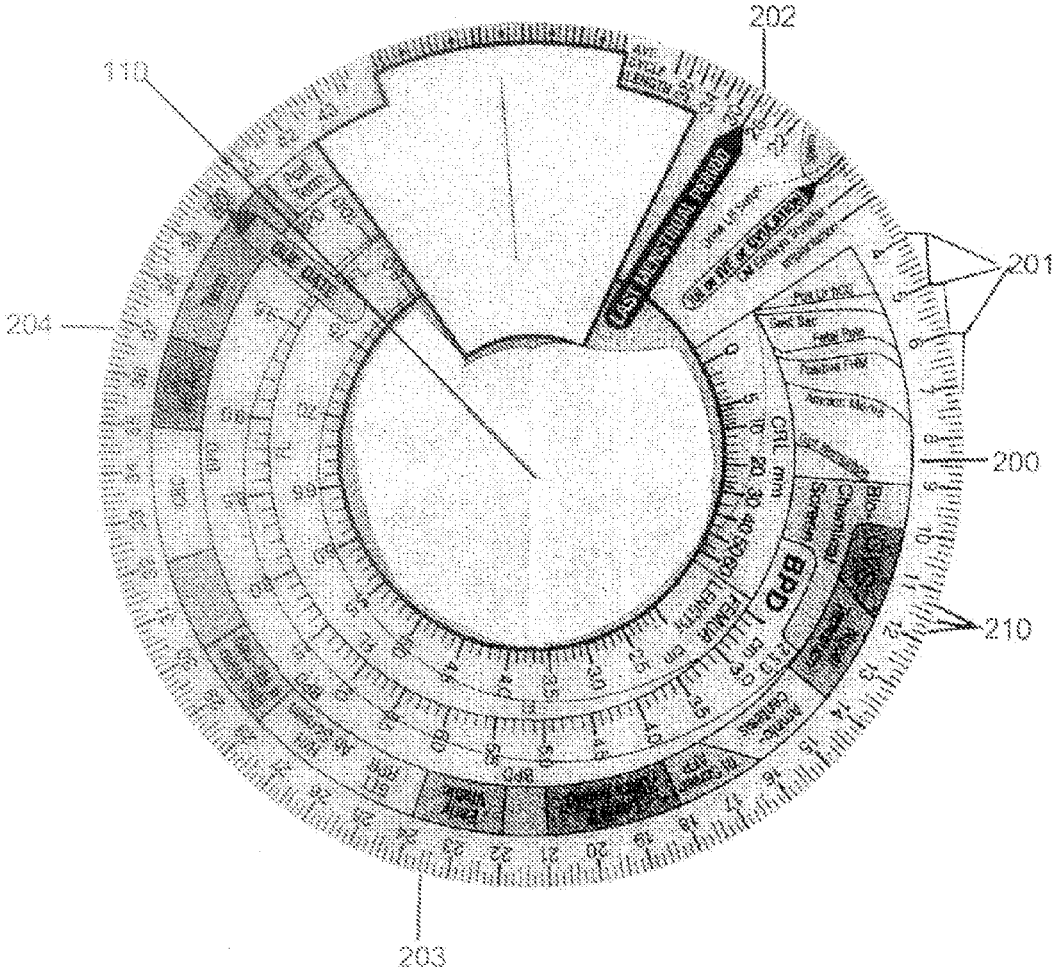
Figure 2: Gestational Plate 500

ADVANCED GESTATIONAL WHEEL CALCULATOR

CROSS REFERENCE TO RELATED APPLICATIONS

This application claims priority from U.S. Appl. No. 60/515,222, filed Oct. 28, 2003, which is incorporated herein by reference for all purposes.

BACKGROUND OF INVENTION

A gestation wheel, also referred to as "a pregnancy wheel," is a commonly used calculation device used by physicians, mid-wives, pregnant women, veterinarians, and the general public to determine the course of a pregnancy, and in particular the estimated date of delivery of a pregnancy. The gestation wheel calculating device has been in general use for several decades, and is invaluable in identifying the calendar dates for different landmarks and phases of pregnancy. The typical embodiment of this device is a circular piece of paper, plastic, or metal between 4 inches and 10 inches in diameter; a 365-day radial calendar printed along the outer circumference on one side; and a separate slightly smaller diameter circular component made of the same material which freely rotates on top of the calendar component by means of a center pin. The smaller rotating circular piece upon which various landmarks of pregnancy are printed is aligned with the calendar component in order to calculate the calendar dates for any pregnancy. The pregnancy landmarks typically consist of a marked position for the last menstrual period, a marked position for the date of delivery for a normal pregnancy, and markers placed seven "days" apart to display and label the number of weeks between the last menstrual period and the delivery date. Because a typical human pregnancy extends 40 weeks from last menstrual period to delivery date, a total of 40 weeks are usually labeled on the rotating wheel. The device is operated by rotating the last menstrual period marker to align with its calendar date, then reading the calendar date aligned with the delivery date marker to identify the estimated "due date" of that particular pregnancy. Any calendar date between these two days will automatically align with the associated "gestational age." Other pregnancy landmarks that correlate with gestational age may also be printed on the marker wheel. These may include segments labeling the first, second, and third trimester; segments that identify the best time to perform tests during pregnancy, such as amniocentesis or diabetes tests; or markers identifying typical fetal weight or fetal ultrasound measurements corresponding to various gestational ages.

Human pregnancy is measured in terms of gestational age and conceptual age. Gestational age is the most commonly used measurement for ongoing pregnancy, and is a relic of the middle ages before egg and sperm physiology was discovered. Essentially it measures the duration of pregnancy from the first day of a woman's most recent menstrual period. The average length of a full-term pregnancy in terms of gestational age is 40 weeks (or 280 days). After the discovery of egg and sperm fertilization, conceptual age was used to more accurately determine the actual duration of pregnancy. Because conception occurs on average 14 days after the onset of the menstrual period, the average duration of pregnancy to full-term delivery is 38 weeks (or 266 days). Despite the increased accuracy of conceptual age, the great majority of gestation wheel calculating devices still use gestational age as the primary unit of measurement for pregnancy duration.

The average duration of a menstrual cycle is 28 days, measured from the first day of one menstrual period to the first day of the following menstrual period. Ovulation typically occurs 14 days after the first day of the period (cycle day 14), and because the lifespan of the egg is only 28 hours, fertilization and conception typically occur less than 1 day after ovulation. Although 28 days is the average menstrual cycle length, the normal range varies from 24 days to 38 days, with this range encompassing 99.5% of all regular menstrual cycles. Approximately 65% of menstrual cycle lengths fall within the range of 26 to 32 days. The variable portion of menstrual cycles is in the period before ovulation. The subsequent period after ovulation is virtually always 14 days long. For a 28-day menstrual cycle, 14 days lie before ovulation and 14 days lie after ovulation. For a 34-day menstrual cycle, 20 days lie before the ovulation and 14 days lie after ovulation.

Several physiologic landmarks occur around ovulation and extend through the first trimester of pregnancy. Ovulation is triggered by a surge in the luteinizing hormone (LH) which occurs 24 to 40 hours before ovulation. This LH surge can be detected by a commercial urine test kit which contains a pad of filter paper sensitive to the LH hormone. The pad of filter paper will become brightly colored on the day immediately preceding ovulation, and is typically used by couples to time sexual intercourse in order to attempt pregnancy. The average lifespan for sperm is 2 to 3 days, although on relatively rare occasions, a small number of sperm can survive as long as 5½ days and still be capable of fertilizing an egg. Timed intercourse to achieve pregnancy is best done on the day of ovulation, and is also acceptable 2 to 3 days before ovulation. In unusual cases timed intercourse 5½ days before ovulation can result in pregnancy. Because the lifespan of the oocyte is 28 hours, timed intercourse more than 24 hours after ovulation is too late to achieve pregnancy, taking into account that it takes over 3 hours for sperm to reach the fertilization site in the fallopian tube.

Once the egg fuses with the sperm, the combined cell is called a zygote. The first cell division occurs 24 hours later, and subsequent cell divisions occur approximately 10 hours apart thereafter. Therefore two days after ovulation the embryo is at the four cell stage, three days after fertilization the embryo is at the eight to twelve cell stage, four days after ovulation the embryo is at the 32 to 128 cell stage and is known as a morula, and five days after fertilization the embryo is known as a blastocyst when it develops a central fluid-filled cavity. The next day (six days after fertilization), the embryo hatches out of a clear thin zona shell, then floats freely in the uterine cavity. The following day the embryo implants into the inner wall of the uterus and acquires a blood supply for further development. Over the next few days the outer placenta circumference enlarges and a fluid-filled amniotic cavity forms, and the embryo secretes enough β-hCG hormone into the bloodstream that its presence can be detected by maternal blood pregnancy test sensitive to this hormone. The blood pregnancy test generally turns positive nine to twelve days after fertilization, and the gestational sac becomes large enough to be visualized on an ultrasound test as a gestational sac approximately 11 to 21 days after fertilization; Within five to nine days, a fetal pole becomes visible on ultrasound inside the gestational sac, with this fetal pole initially growing approximately 1 mm per day in length (the crown-rump length or CRL). Two to five days after the fetal pole becomes visible, the fetal heart develops to the point that a steady beating heart motion is detected on ultrasound, initially around 60 to 90 beats per minutes, then increasing to 110 to 150 beats per minute (fetal heart motion or FHM).

Over the next two weeks, the gestational sac and the fetus become larger with more details visible on ultrasound, and a thin membrane surrounding the fetus known as the amnion sac becomes visible.

The gestational age ranges for development of specific organ systems is well documented. The beginning, mid-range, and ending developmental phase for organs such as the eye, genitalia, arms, legs, and heart are well established and this period is known as organogenesis. If environmental or other insults occur in the developing tissues during this period, birth defects in a particular organ system may result. After the organogenesis phase, the fetus simply grows larger and larger until delivery, so environmental insults occurring during the growth phase may cause retarded or accelerated growth and result in low birth weight or high birth weight infants, but insults during the growth phase do not cause birth defects.

Various organs and fetal structures can be measured by gestational ultrasound during pregnancy, and standard tables of these measurements have been developed, with growth curves calculated for each gestational age, complete with normal ranges and standard deviations. Examples of gestational ultrasound measurements include transverse skull measurement (biparietal diameter or BPD), length of the femur bone (FL), circumference of the abdomen and head (AC and HC), diameter of the cerebellum, and distance between eyeballs. These measurements can then be used to determine secondary factors such as estimated fetal weight or head circumference to abdominal circumference ratio by applying the appropriate algorithm. Each of these secondary calculation factors has its own growth curve and normal range standards when compared to gestational age.

A large number of pregnancy medical tests must be performed within a narrow range of gestational age due to physiologic restrictions. For instance the chorionic villus sampling test (CVS) must be done between 10 and 12 week gestation, and the amniocentesis test is best done between 14 and 16 weeks gestation. Gestation calculating wheels are often used to determine the calendar date of these tests for individual pregnancies. A very important task of medical personnel during pregnancy is the accurate determination of the most likely day of full-term delivery (due date or estimated date of confinement "EDC"). Three weeks before and two weeks after the due date is considered term, and is the safe time to delivery the baby. Delivery before term may result in prematurity with its associated problems. Deliveries after term are considered post due or post term, and these deliveries are also associated with a very high complication rate.

Most gestation calculating wheels contain only three types of information marked on the rotating plate—1) the first day of last menstrual period, 2) the due date, and 3) the weeks of gestational age in between. Other information is occasionally included such as scheduling periods for various pregnancy tests like CVS and amniocentesis, between the appropriate gestational age week markers.

Prior art wheels include those disclosed in: U.S. Pat. Nos. 4,737,619; 2,727,686; 3,278,118; 2,418,207; 4,350,878; 3,486,691; 3,771,716; and 2,808,206; US Publication No. 2003/0024974; PCT publication nos. WO 97/33214 and WO 01/36212; and web sites http://www.cdphe.state.co.us/ps/bestpractices/topicsubpages/inadequateweightgain.html; and www.pregnancyplanningguide.com/about_pregnancy.cfm.

Gestational calculators often contain additional space which is not involved with the calculation of gestational markers. The additional space is usually located near the center of the wheel inside the gestational markers, on the entire back side of the base plate, on the ¼ circumference of the gestational plate between the due date and the last menstrual period markers. Some of this space is available because human gestations are approximately nine months in length, and the remaining three months of the year have no associated markers.

The physical structure of most gestation wheels consists of a circular (or less often rectangular) "base plate" upon which a 365-day calendar is printed along the outer circumference. The months of the year are printed sequentially around the outermost circumference, dividing the base plate into 12 monthly segments, and the days of each month are printed within as short lines along a circumference immediately inside the month labels. Typically every five or ten days is numerically labeled in order to locate a specific calendar date. For instance, within the segment labeled January, every 5th mark is labeled with a numeral "5, 10, 15, 20, 30." January 12th would be the second marker after the one labeled "10." The center point of the calendar base plate contains a pin which connects the base plate to a second circular plate which freely rotates concentrically over the base plate. This is the gestational plate, and printed radially upon the outer circumference of this plate are markers for the typical landmarks of pregnancy. This nearly always includes a marker for the first day of the "last menstrual period," a marker for the "due date," and markers located seven days apart and occupying approximately nine months duration between the menstrual period and "due date" marker. These are each labeled with a number representing the gestational age in units of weeks. For instance the marker labeled 22 would mark the point on the circumference associated with the 22nd week after the last menstrual period. By rotating the gestational plate along the base plate, the last menstrual period marker can be directly aligned with the calendar date for a particular pregnancy. For example, if the patient's last menstrual period lasted from March 4th to March 8th, the last menstrual period marker would be aligned directly on top of the March 4th marker on the base plate. Once this is done, the calendar date of all other gestational markers, including the due date, can be read on the calculator when the two plates are held fixed in this position. It is common that the gestational age weekly marks extend to 42 or 44 weeks gestation in order to accommodate post-due pregnancies. Some of the more modern gestational calculators will also contain markers for LH surge, ovulation, fertilization, and even a few phases of embryo or fetal development.

SUMMARY OF THE INVENTION

The gestational wheel calculator of the current invention greatly extends the function and usefulness of the basic gestational calculation wheel by providing increased accuracy of gestational dates by using an average cycle length adjuster, provides paternity information using a sperm exposure marker, provides more accurate ultrasound and other test measurements by using scales printed parallel to gestational age, and provide a means of accurately aligning these measurements with the proper calendar or gestational date by including a transparent marker arm. In addition, normal range and error functions are included on the marker arm. A one-fourth year window is used to increase the surface area of information available for viewing charts, tables, and promotions on the underlying base plate. Easier reading of the calculator is provided by special markers for the first day of each calendar month and by providing sub-marks for each day within a gestational week. Scheduling conflicts are improved by providing a weekday scale covering the entire nine month duration of pregnancy. The other side of the gestational wheel can be used to provide additional promotional or informational items including rotating transparent windows to display additional surface area, to provide means of calculating algorithm solutions for body mass index, and display observational data for EFW, delta OD 450, and AFI.

BRIEF DESCRIPTION OF THE DRAWINGS

FIG. 2: shows an embodiment of a gestational age plate for a gestational wheel calculator.

DETAILED DESCRIPTION

Several significant improvements can be made to prior art gestation calculating wheels. These improvements include an increase in accuracy and expansion of the associated information, therefore increasing the overall utility of the wheel.

The physical structure of the gestation calculating wheel of the present invention is similar to the wheel of the prior art. For example, it comprises primarily a base plate connected to a gestational marker plate by means of a center pin allowing free rotation of each plate. However, the present invention takes the prior art designs further in that the physical structure is extended to include additional freely rotating plates stacked on each side of the base plate, all connected by a concentric pin. Some of the additional plates are transparent or contain transparent windows which allow viewing of material printed on the underlying plates, significantly extending the usefulness of the device.

The material used for construction of the new device can consist of plastic, wood, paper, cardboard, or metal, with the transparent portions composed of plastic, plexiglass, or glass.

Calendar Plate

Figure 1:
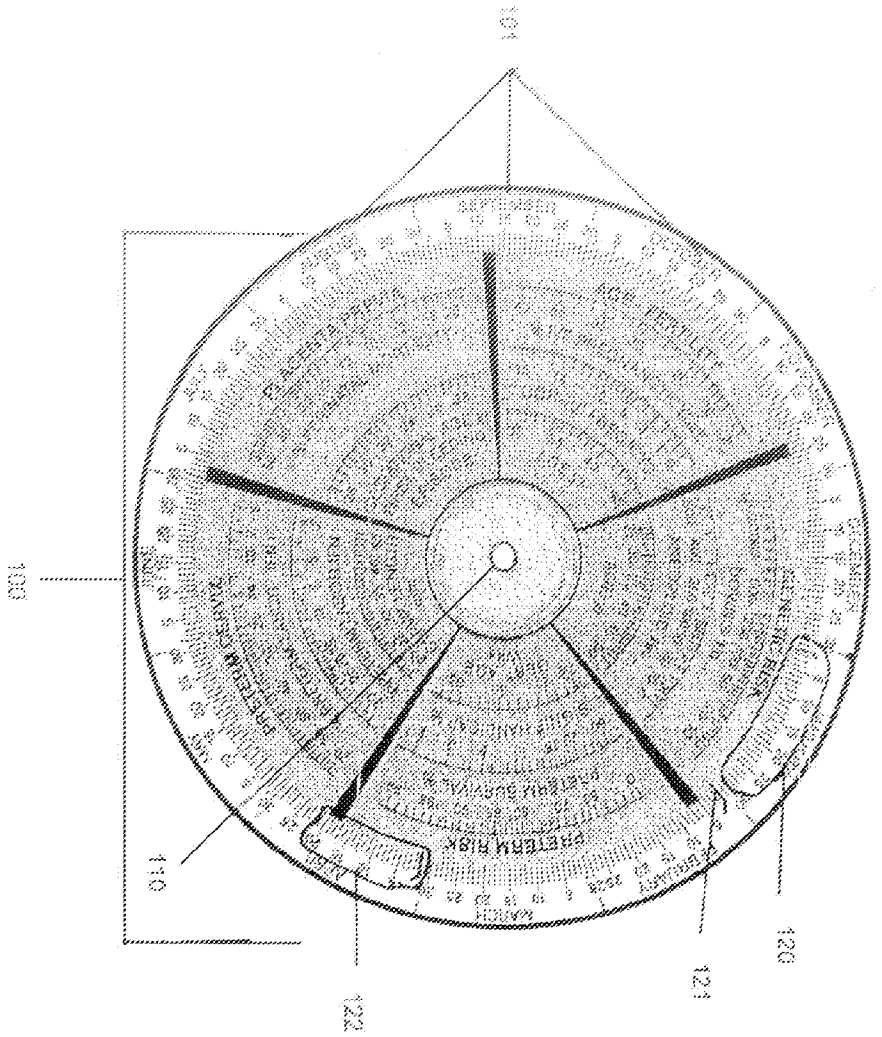
FIG. 1: shows one embodiment of a calendar plate for a gestational wheel calculator.

FIG. 1 illustrates one embodiment of the Calendar Plate for the present invention. The Calendar Plate of the present invention comprises segments (101) which represent months of the year arranged in a circular pattern about a central axis (110). As the normal human gestational period is nine months, a preferred embodiment of the invention presents a Calendar Plate with at least nine months and not greater than twelve months. Each of the month segments comprise at least one and not greater than thirty-one marks (120) which correspond to particular calendar days. The marks are spaced from adjacent marks by a predetermined angle with respect to the axis (110). Each month segment contains a first mark (121) which looks different than the other marks of the month (122). The purpose of this is to make it easier for the user to determine the first day of the month. This is because determining an unlabeled marker at the very end and very beginning of each month is often difficult, especially with the number of unlabeled markers typically ranging between four and five. The greatest difficulty is distinguishing between the last day of the month and the first day of the succeeding month if these markers are otherwise identical. In one embodiment of the invention, a first day of month marker (121) is a simple diagonal line arising from the top of the appropriate marker, with the diagonal pointed away from the previous month to avoid overlap with the numerical marker "30" or "31." This marker avoids the mental effort of counting up or back to determine the first of the month, allowing more accurate alignment of the other rotating wheels on the calculator. Other options for first day markers may include but are not limited to making the first day of month mark a circle, oval, triangle broken line, square, heart, letter, number, or other similar shapes to denote a difference from a simple unbroken line which is the same length as all other lines representing days of the month.

Figure 1B:
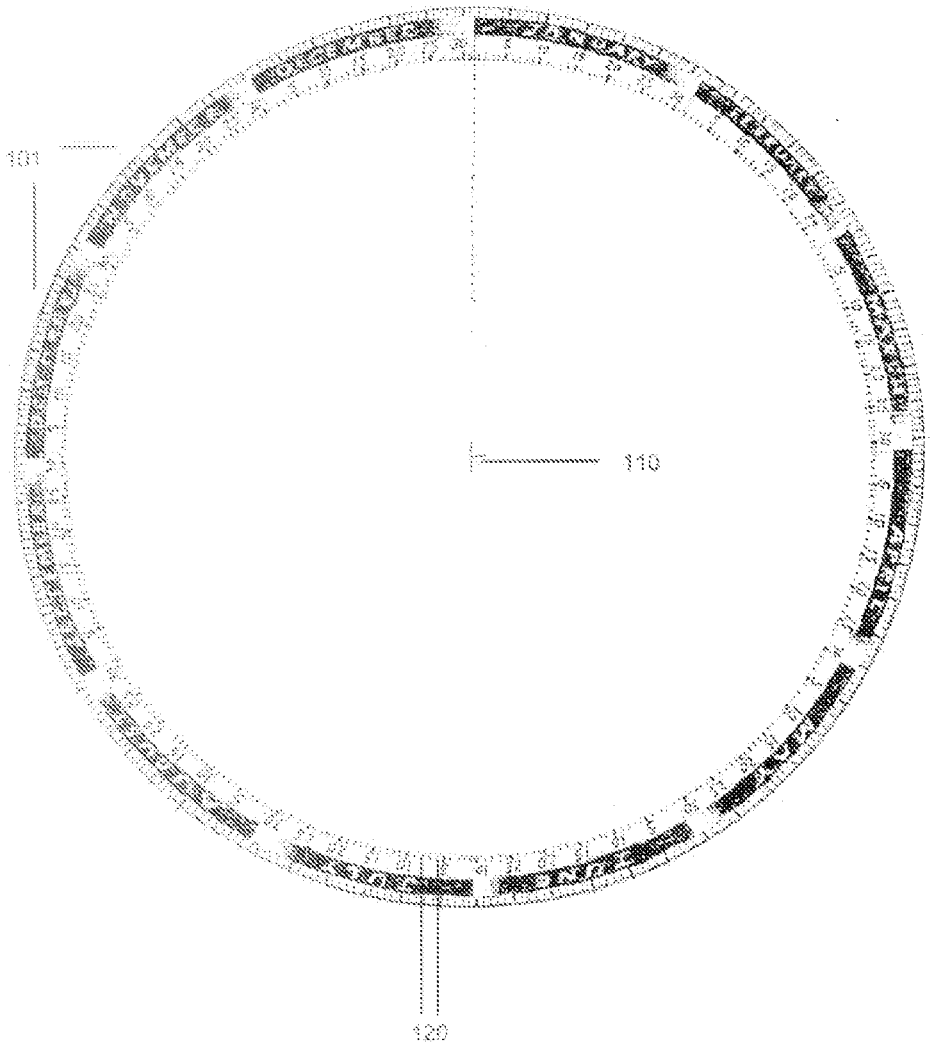
FIG. 1B: shows a second embodiment of a calendar plate for a gestational wheel calculator.

Another embodiment of the calendar wheel of the current invention is illustrated in FIG. 1B.

Gestational Age (Week) Scale

FIG. 2 illustrates a second plate, called the Gestational Age Plate "Gestational plate" (500) upon which a gestational age scale (200) organized by week is located. The week scale is useful in that gestational age is typically labeled in units of weeks and days, for instance, "16 weeks 5 days" or "41 weeks 6 days" gestation.

By placing the week scale on a separate plate from the Calendar plate, the user may position the "zero" mark (202) of the week scale in line with the mark representing the first day of the last menstrual period on the Calendar plate. Once this is done, calculation of when milestones in development should occur as well as the scheduling of various tests is simplified. The week scale comprises segments (201) which represent weeks of the year arranged in a circular pattern about a central axis (110). As the normal human gestational period is 40 weeks, a preferred embodiment of the invention presents a week scale with at least 40 and not greater than 52 weeks. Each of the week segments comprise at least one and not greater than seven marks (210) which correspond to days. These marks are spaced from adjacent marks by a predetermined angle with respect the axis (110). In a preferred embodiment, the marks of the week plate are spaced at the same predetermined angle as the marks of the Calendar plate. If a one week duration is spaced the same on both the Calendar plate and the week scale than the user may easily look at a particular date on the Calendar plate and the exact calendar date three weeks later will be immediately apparent as it is in line with the three week mark on the week scale.

Figure 2B:
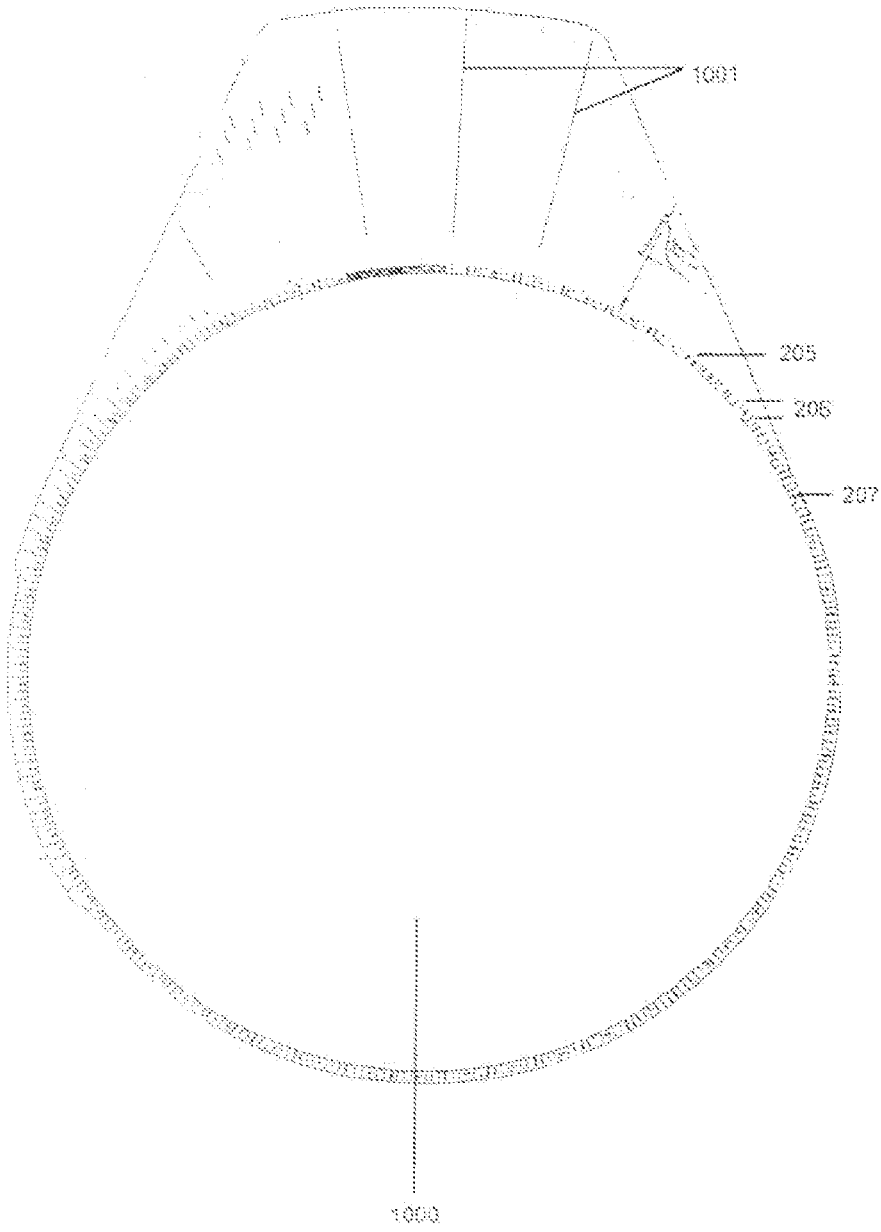
FIG. 2B: shows a transparent marker arm for a gestational wheel calculator with days of the week markings
Figure 2C:
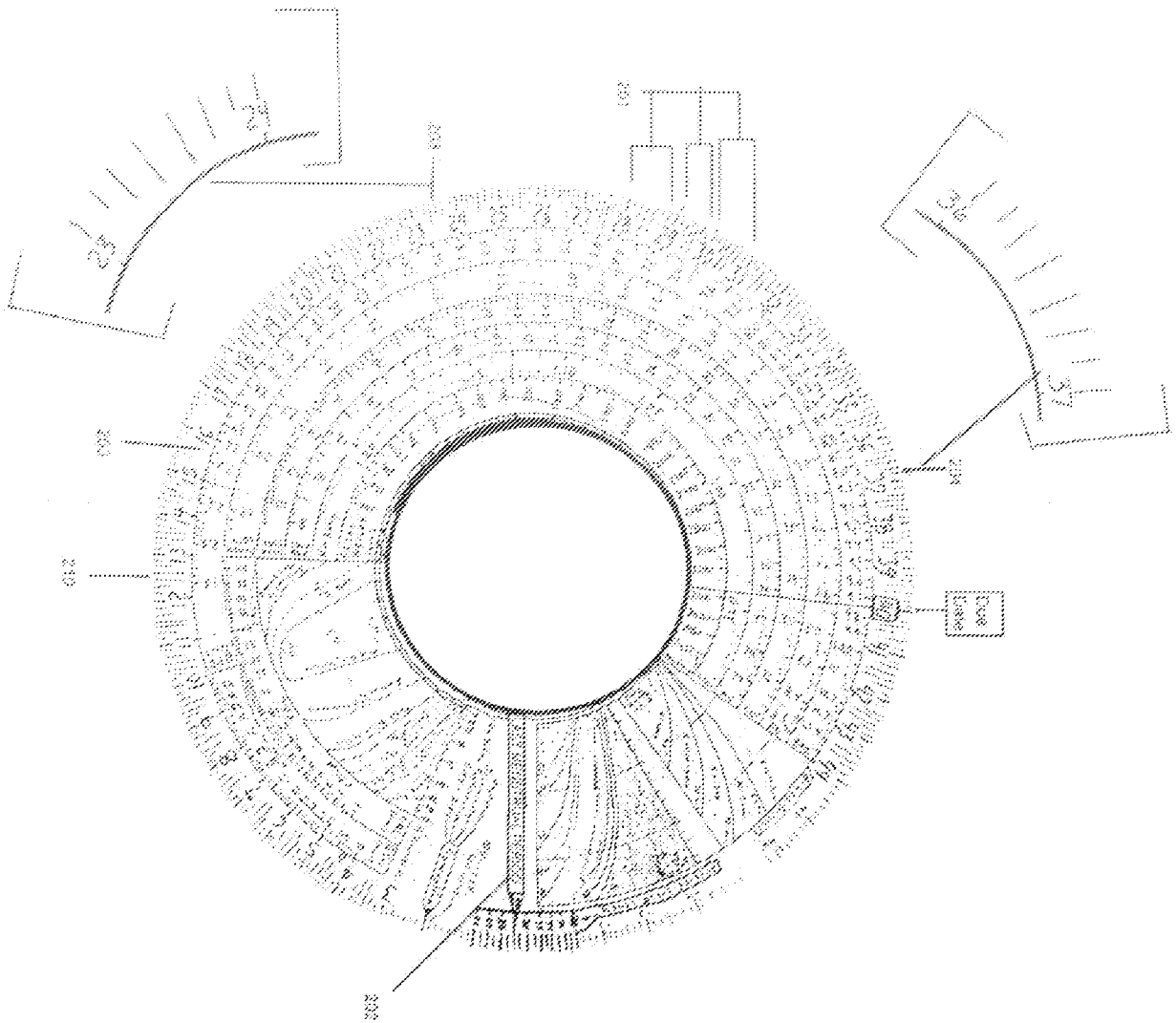
FIG. 2C: shows a second embodiment of a gestational age plate for a gestational wheel calculator.

Another embodiment of the gestational age plate of the current invention is illustrated in FIG. 2C.

Weekday Sub-Markers

An embodiment of the present invention makes reading intermediate days between weekly markers simple and accurate by changing the size or shape of the individual sub-weekday markers in a consistent manner week to week. For larger diameter wheels, it is feasible to make the "day 1" and "day 6" markers smallest or shortest, with slightly longer markers for "day 2" and "day 5," with the longest markers reserved for "day 3" and "day 4." Because the markers immediately adjacent to the weekly marker are shortest, they provide more room for the numerical label for the weekly marker. With minimal familiarity, the user can easily determine which specific gestational age is displayed. There may be insufficient room on smaller diameter wheels to allow three separate sub-day marker lengths, so two separate lengths may be substituted. A typical example would be two short length markers for "day 1" and "day 2," followed by two long length markers for "day 3" and "day 4," followed again by two short markers for "day 5" and "day 6." For instance, 23 weeks 4 days gestation would be represented by the long marker between the 23rd and 24th weekly labels (203), and the position for gestational age 36 weeks 6 days (204) would be the short marker immediately before the weekly mark labeled "37."

Weekday Scale

A rotating weekday scale can be placed along the markers for the current calendar day scale or gestational age scale. This would allow determination of the day of the week and weekend for any calendar day or associated gestational day to simplify scheduling of patient appointments or laboratory tests on weekdays and avoid scheduling these items on weekends, or to schedule events such as surgeries on particular weekdays such as Fridays only. In one embodiment of the invention, markers along the outer circumference of the weekday scale are used with easy to read labels repeating every seven days. On larger gestational wheels, it is feasible to label each position with a letter corresponding to the day of the week (S, S, M, T, W, T, F, S, S . . . ). For smaller gestational wheels with insufficient space to print letters, a repeating design which is intuitively easy to interpret can be substituted. An example as illustrated by FIG. 2B would be bold thickness markers for Saturday and Sunday (205), thin markers for the other weekdays (206), and a cross bar or dot on the Wednesday marker (207). The weekday scale could be mounted on a separate rotating wheel, or could be placed on the marker arm as described below.

Because the number of days in a week (7) is not a factor of the number of days in a year (365 or 366), a weekday scale can not continue along the entire circumference of the year. This is because weekdays would mismatch at the starting point. For this reason, one embodiment of the current invention leaves gap between the start and finish points of the weekday scale. Because normal human gestation is nine months long, the weekday scale could extend just beyond nine months and still encompass the entire pregnancy. By aligning any one weekday against its calendar date, the rest of the scale would automatically align for the duration of the pregnancy.

Average Cycle Length Scale

Figure 3:
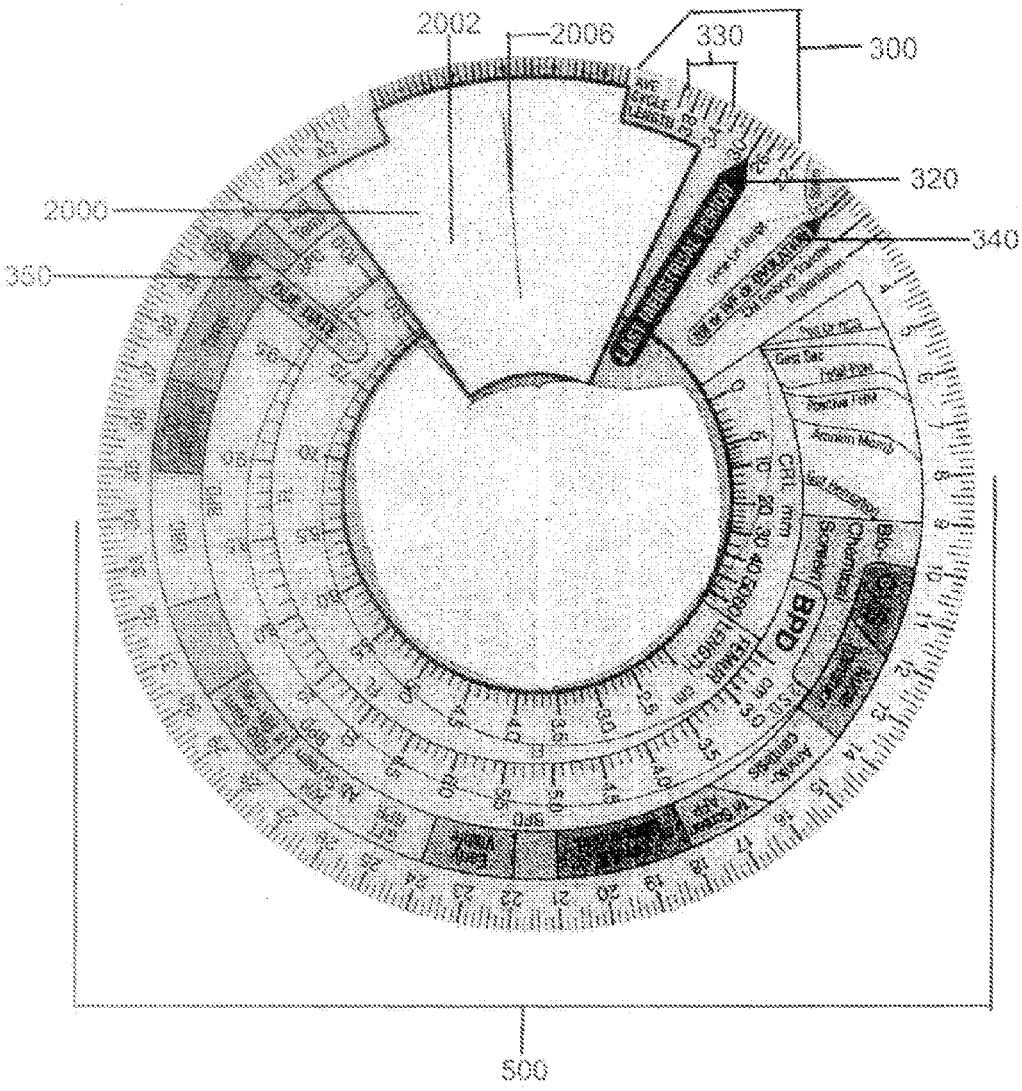
FIG. 3: shows a gestational age plate with a transparent quarter year window and an average cycle length scale.

The average human menstrual cycle length is 28 days. Usually gestation calculation wheels print the marker for the last menstrual period at a position corresponding to a 28-day cycle. However, 60% of women will have an average cycle length ranging from 26 to 32 days, and 99.5% of women will have a cycle length ranging from 24 to 38 days. Virtually all the variability in cycle length is within the follicular phase of the menstrual cycle before ovulation, and virtually all women have a fixed length of 14 days between ovulation and the following menstrual period. If the patient achieves pregnancy, then the gestational age is more accurately associated with the time of ovulation, not the last menstrual period. FIG. 3 illustrates an innovation of the current invention which involves printing an average cycle length scale (300) to significantly improve the accuracy of the gestational calculation wheel. Using a calculator meant for a woman with a 28-day cycle, a woman with an average menstrual cycle length of 38 days will have a 10-day error introduced throughout her pregnancy once the "last menstrual period" marker is aligned with the calendar position of the 1st day of her last period. All calendar days for subsequent gestational landmarks, including due date, will appear to be 10 days early. The current invention automatically compensates for variations in average cycle length between women by printing a secondary scale on the gestational plate (500) on either side of a flag labeled "last menstrual period." (320) The primary label for the last menstrual period is still located at the most frequent position for a 28-day cycle, but 10 days before and 4 days after this position are marked with a scale of 1 day increment markings (330), with these increments labeled with numerals representing the individual patient's average menstrual cycle length. For instance, if a patient has an average menstrual cycle length of 38 days, the marker labeled "38" (located 10 days before the flag for the "last menstrual period") is used. When this "38"

day marker is aligned with the patient's calendar day of her last period (located on the Calendar plate), the rest of the gestational markers on the wheel are now appropriately and accurately aligned with the patient's actual gestational physiology. The markers for ovulation (340) or for due date (350) are now properly aligned, taking into account the 10 extra days that occurred before ovulation. In one embodiment of the invention, the Gestational plate allows for average cycles of 22 to 40 days. This range may be expanded in order to accommodate shorter or longer cycles.

Figure 3B:
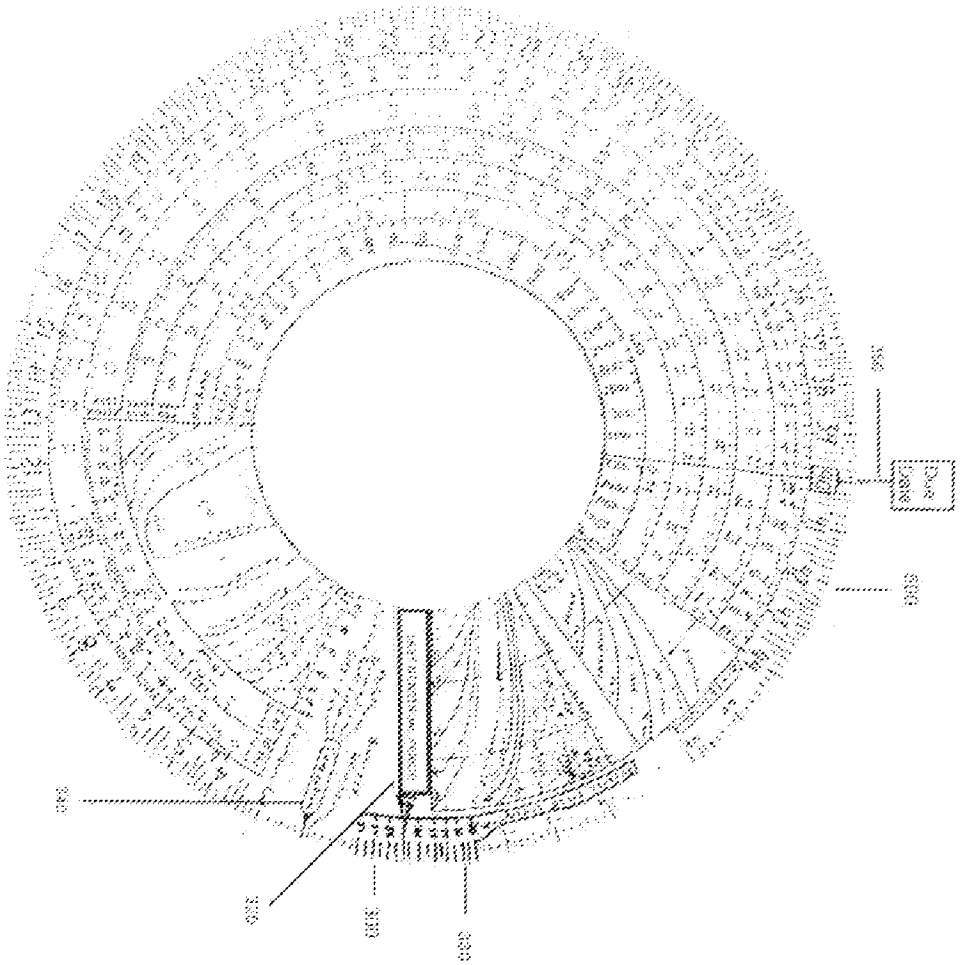
FIG. 3B: shows a second embodiment of a gestational age plate with an average cycle length scale.

Another embodiment of the average cycle length scale of the current invention is illustrated in FIG. 3*b*.

Intercourse Timing Calculator

Figure 4:
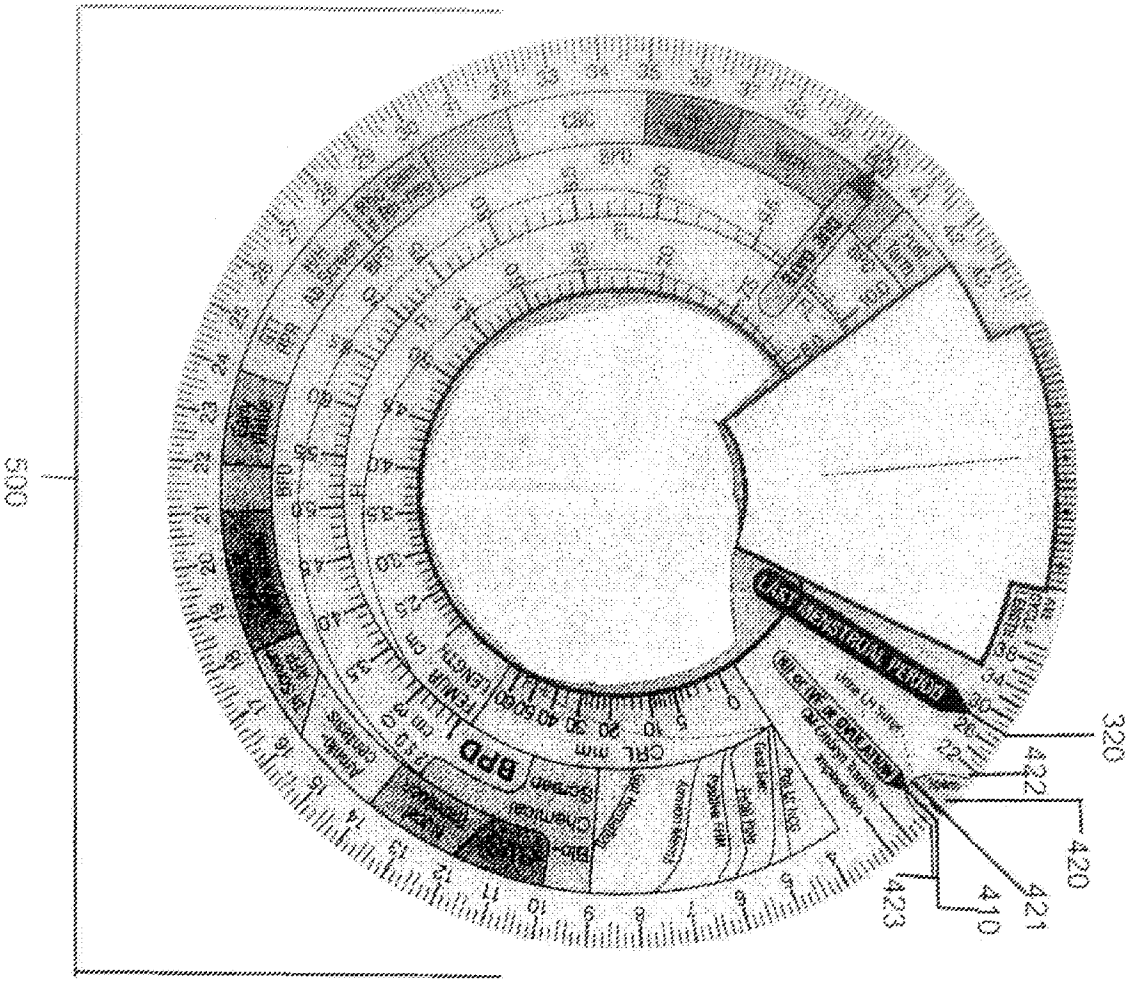
FIG. 4: shows gestational age plate with an intercourse timing calculator.
Figure 4B:
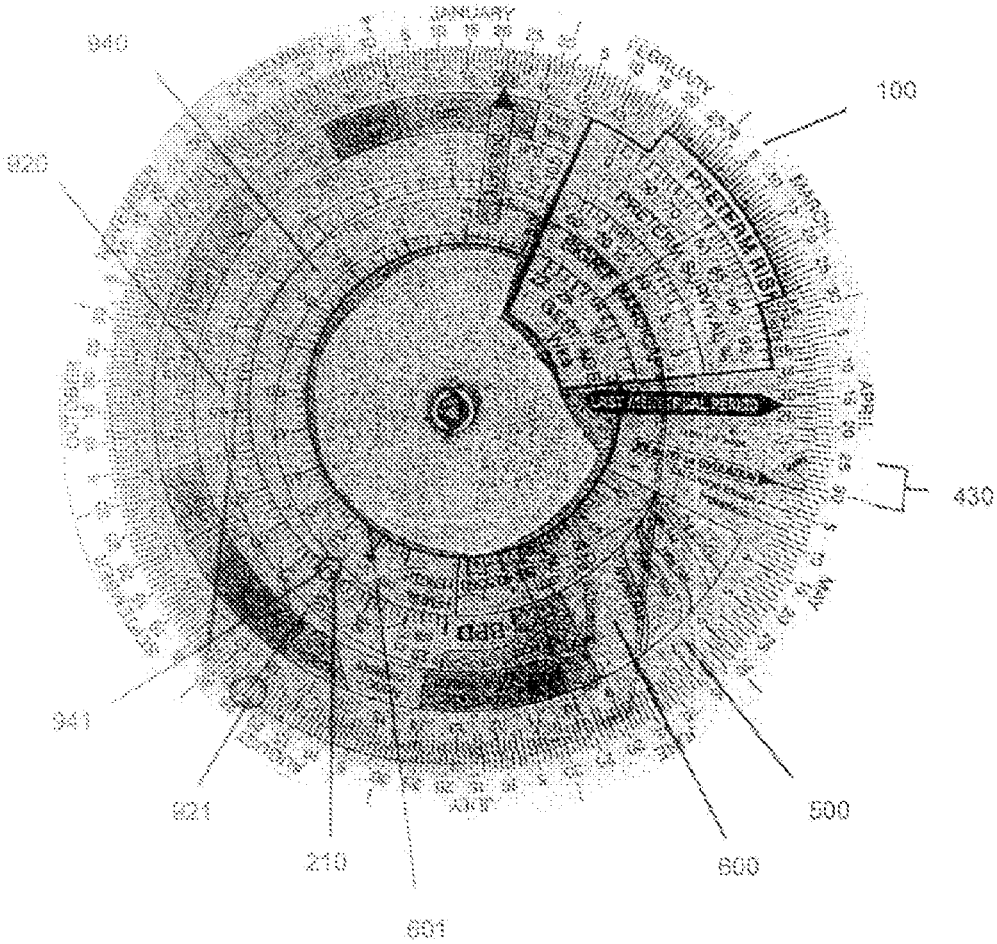
FIG. 4B: shows an advanced gestational wheel calculator showing the most likely calendar days that resulted in fertilization and establishment of pregnancy.

FIG. 4 illustrates one embodiment of the invention where on the Gestational Plate (500), an ovulation (or fertilization) marker (410) is placed 14 days after the standard 28-day last menstrual period label (320), and the egg survives only 1-day beyond the ovulation marker. A mathematical curve (420) representing the expected population survival of sperm can be printed on the gestational plate (500), displaying the probability of sperm exposure (intercourse or insemination) and the associated likelihood that the lifespans of the sperm and egg will overlap. The sperm probability marker (420) extends only 24 hours after the ovulation marker (410), and extends three to five days before the marker, with a peak height displayed immediately before ovulation (421). The appropriate probability slope for sperm survival decreases to zero on each side of this position (422 and 423). When properly aligned with the calendar base plate (100), as illustrated by FIG. 4B, the user now reads the most likely calendar days (430), of sperm exposure (in this case April 25 through May 2) which resulted in fertilization and establishment of the pregnancy.

Figure 10:
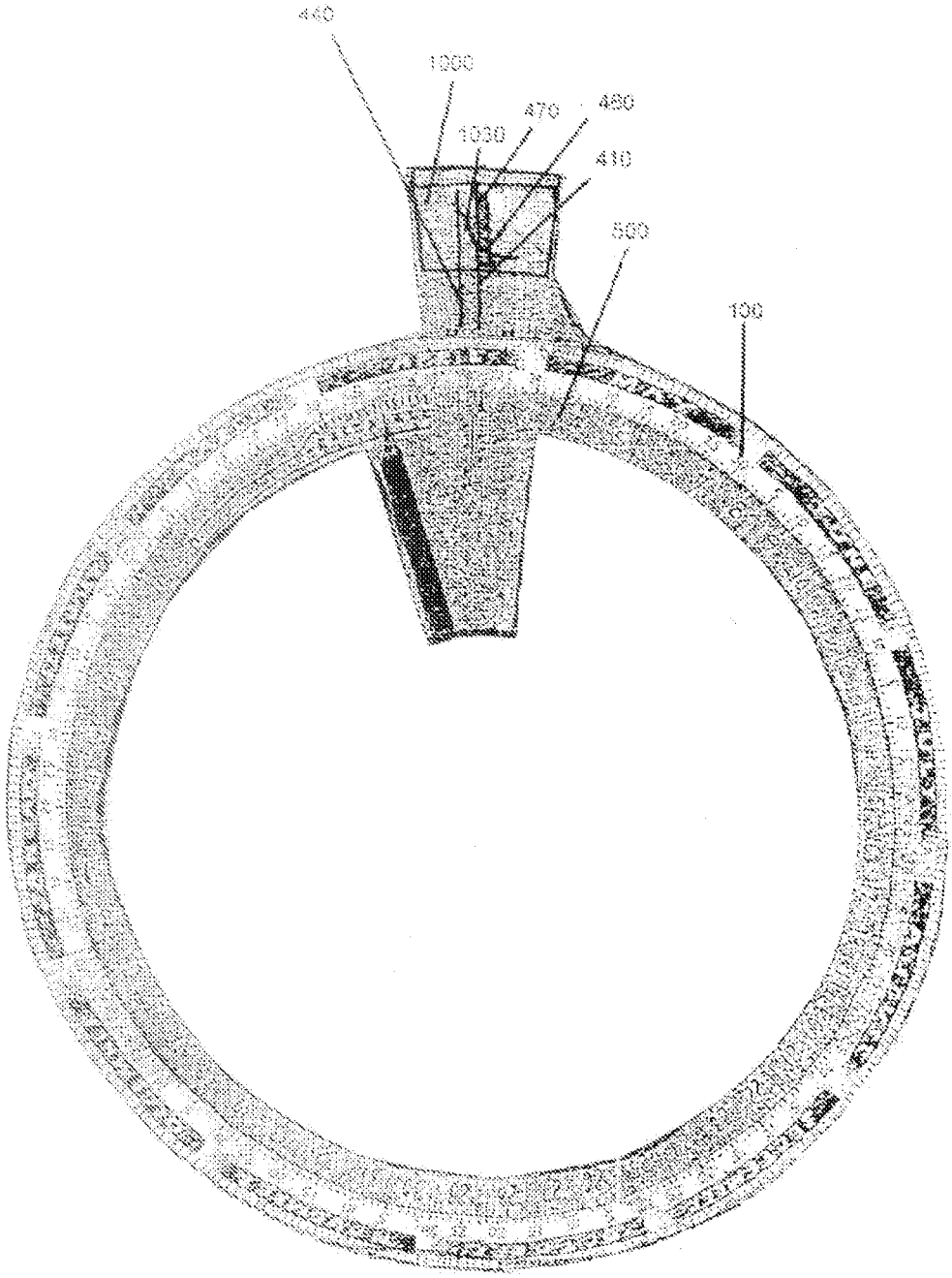
FIG. 10: shows a second embodiment of an intercourse timing calculator utilizing a transparent plate containing a sperm probability curve.

Two types of sperm exposure range markers may be used with this invention. The first type is described above, with a probability curve (420) printed directly on the gestational landmark wheel on each side of the ovulation marker (410). A second type is illustrated in FIG. 10 and consists of a probability curve (1030) printed on a third transparent plate (1000) resting on top of the gestational landmark plate (500). This third transparent plate (1000) may have a label marked "timed intercourse" or "insemination" radially extending to the outer circumference of the plate, with a sperm probability decay curve (1030) beginning at the time of intercourse or insemination, then decreasing down to zero approximately five to six days after this marker. By rotating the top plate (1000) over the gestational landmark plate (500), and aligning the intercourse or insemination event (440) with the calendar day on the base plate, the degree of overlap between the sperm survival probability (1030) and the time of ovulation (410) can be easily determined. Even greater accuracy can be achieved if the gestational landmark plate (500) contains a 28 hour (or 1-day) probability range (470) for survival of the egg, preferably a different color or density of ink. The actual area of overlap (460) between sperm survival probability and egg survival probability can then be directly visualized. This innovation may be useful in helping to solve probabilities of paternity if more than one male partner had intercourse within a specific time period.

Gestational Ultrasound Landmark Probability

During normal pregnancy there is a range of gestational time within which certain fetal development landmarks first become visible on ultrasound tests. For instance, the time in which fetal heart motion is first detected by ultrasound ranges from 5 weeks 0 days gestation to 6 weeks 4 days gestation, with an average of 5 weeks 5 days gestation. Standard probability curves for these ultrasound events have been plotted within the range of gestational time for each event. In a normal pregnancy, the probability of visualizing fetal heart motion at 4 weeks 6 days gestation is 0%, the probability of visualizing fetal heart motion at 6 weeks 5 days gestation is 100%, and the probability of visualizing fetal heart motion at 5 weeks 5 days gestation is 50%. Fetal development landmarks become visible on ultrasound or by medical tests in a sequential order. The β-hCG pregnancy hormone is first detected by a blood test between 3 weeks 1 day and 4 weeks 0 days gestation, followed by first detection of the β-hCG level hormone in the urine between 3 weeks 4 days and 4 weeks 4 days gestation. This is followed by first detection of the gestational sac by ultrasound visualization, then detection of the yolk sac, then fetal pole, then fetal heart motion, followed by appearance of the amnion membrane after which fetal intestinal herniation is visualized. Each of these events occurs within a specific range of gestational time, and with a specific probability of detection on each day in the respective range. Some fetal development events are reversed later in pregnancy, for instance the fetal amnion membrane will disappear between 10 weeks 4 days gestation and 13 weeks 3 days gestation.

Figure 7:
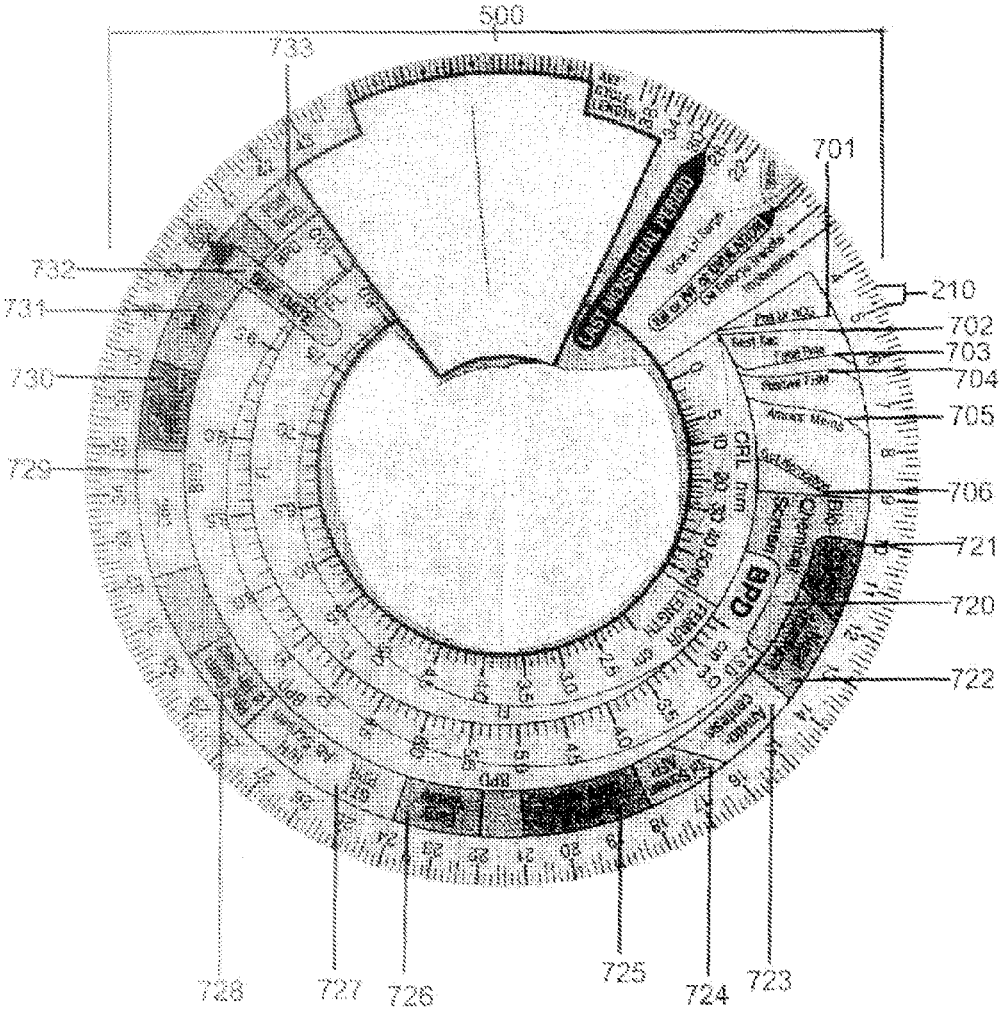
FIG. 7: shows a calendar wheel of a gestational wheel calculator with probability curves for likelihood of viewing various items with an ultrasound.

It would be desirable for gestational calculation wheels to include a means of determining the range and probability of detection of fetal development events. An embodiment of the current invention displays the probability of detecting a fetal development landmark for any gestational age or calendar date customized for any pregnancy. This is accomplished, as illustrated by FIG. 7, by plotting the standard probability curve (701, 702, 703, 704, 705, or 706) for one or more fetal development events on the gestational plate (500) below the markers for gestational age (210), using gestational age as the "X-axis" and the probability of detecting the fetal development event on "Y-axis." These curves include, but are not limited to Pos Ur hcg (701), Gestational Sac (702), Fetal Pole (703), Positive FHM (704), Amnion Meb (705), and Gut Herniation (706). Greater accuracy in determining probability can be achieved by mounting a transparent rotating plate (600), above the gestational plate (500), upon which a radial Y-axis (601) is printed containing a linear or non-linear probability scale (620). Looking at FIG. 7B, when the Y-axis marker (601) is aligned with the gestational day (210) and the corresponding calendar day (120) printed on the plates below, the probability scale (620) will overlay the probability curve (706) printed on the gestational plate (500) below. The probability value of the fetal development event in question is then displayed at the point where the probability scale and probability curve cross (710). In one embodiment of the invention, if the transparent probability scale marker is aligned at the six weeks two days position on the gestational plate below, then the probability curve for fetal heart motion printed on the gestational plate will cross the probability scale printed on the overlaying transparent plate at the 50% point. This device is very useful in determining the normalcy of fetal development during a pregnancy on specific calendar days or for the readjustment of gestational age for pregnancies with uncertain menstrual dating.

Figure 18:
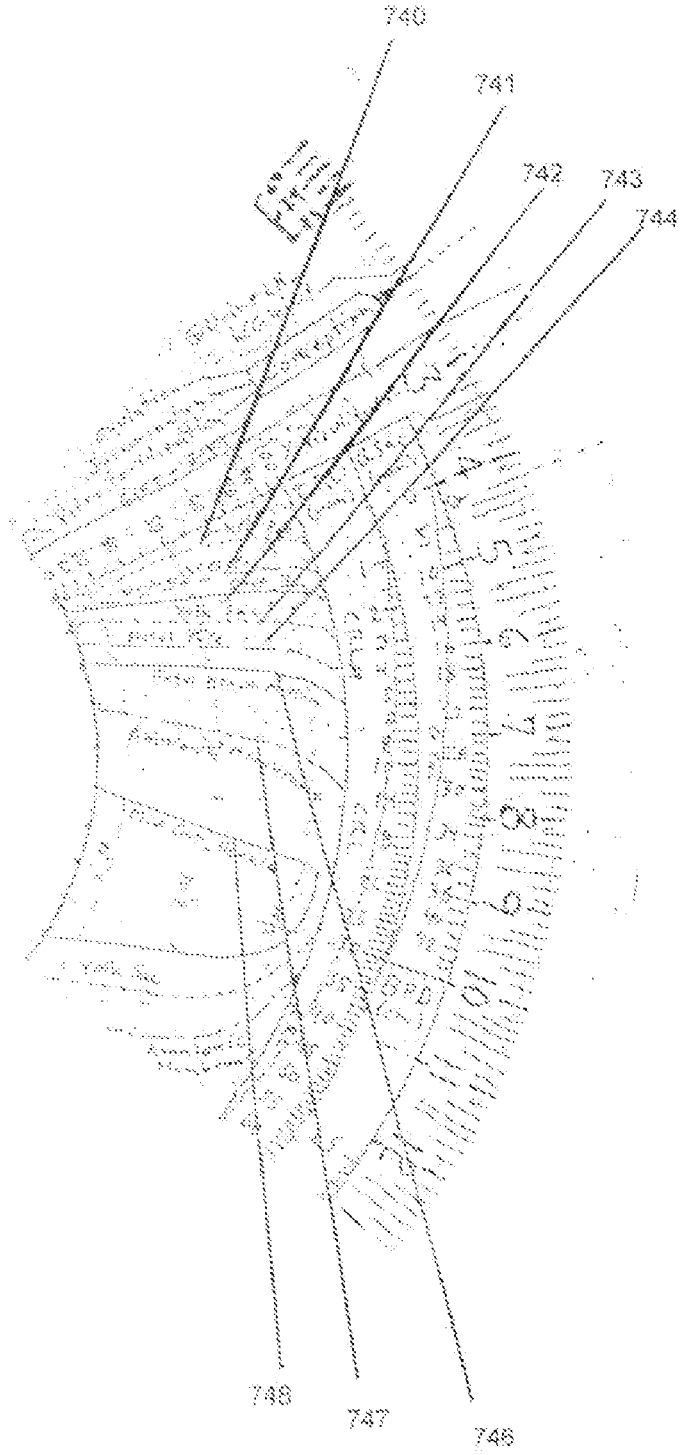
FIG. 18: Third embodiment of ultrasound measurements.

FIG. 18 is another embodiment of the current invention which depicts probability curves for the fetal developments of β-hcG pos. (740), Urine-hcG pos (741), Gestational Sac (742), Yolk Sac (743), fetal pole (744), fetal heart motion (746), amnionic membrane (747), and mid gut hernia (748).

Gestational Ultrasound Medical Test Measurement Scales

Figure 9:
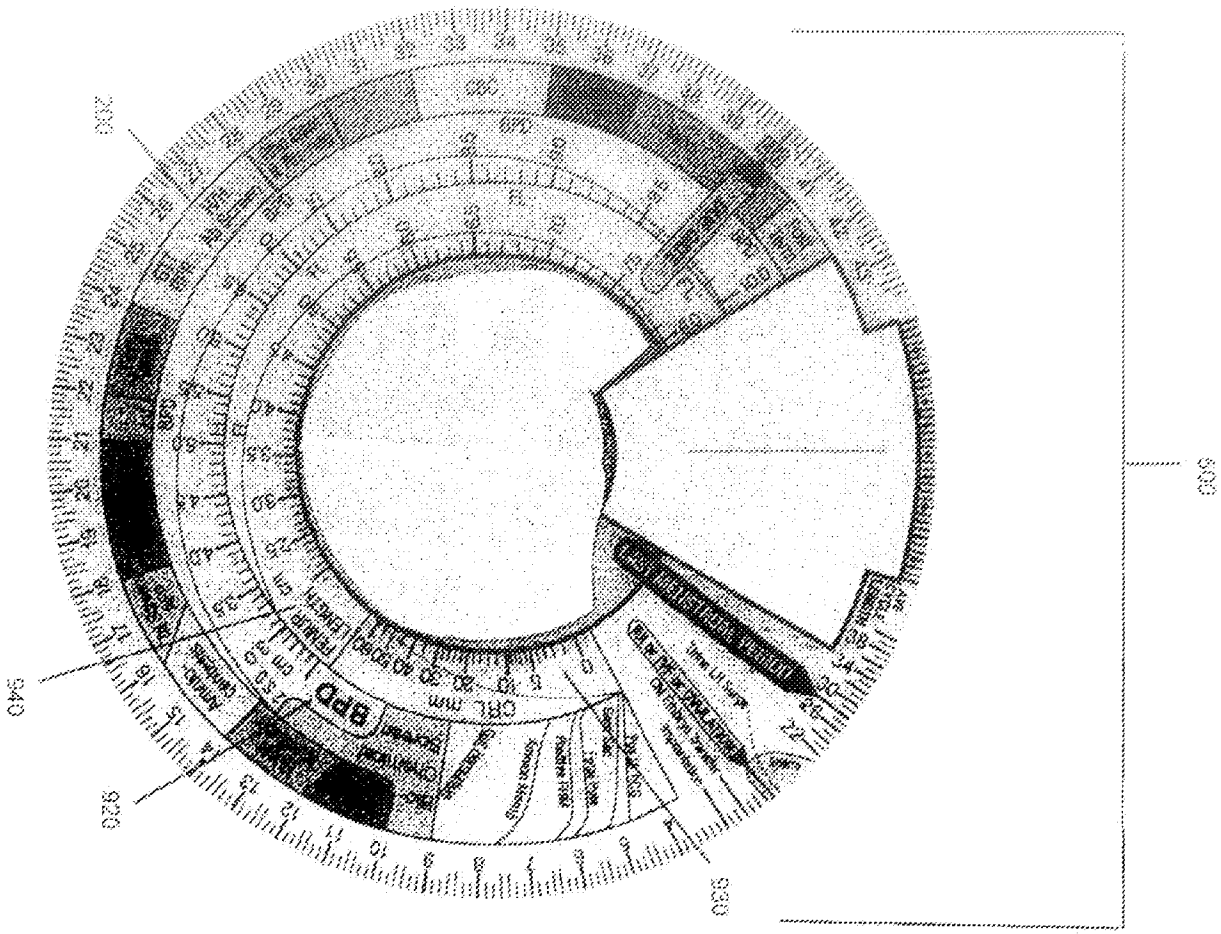
FIG. 9: shows pregnancy medical tests or ultrasound measurements as continuous variables parallel to the gestational age scale on a gestational plate.
Figure 9B:
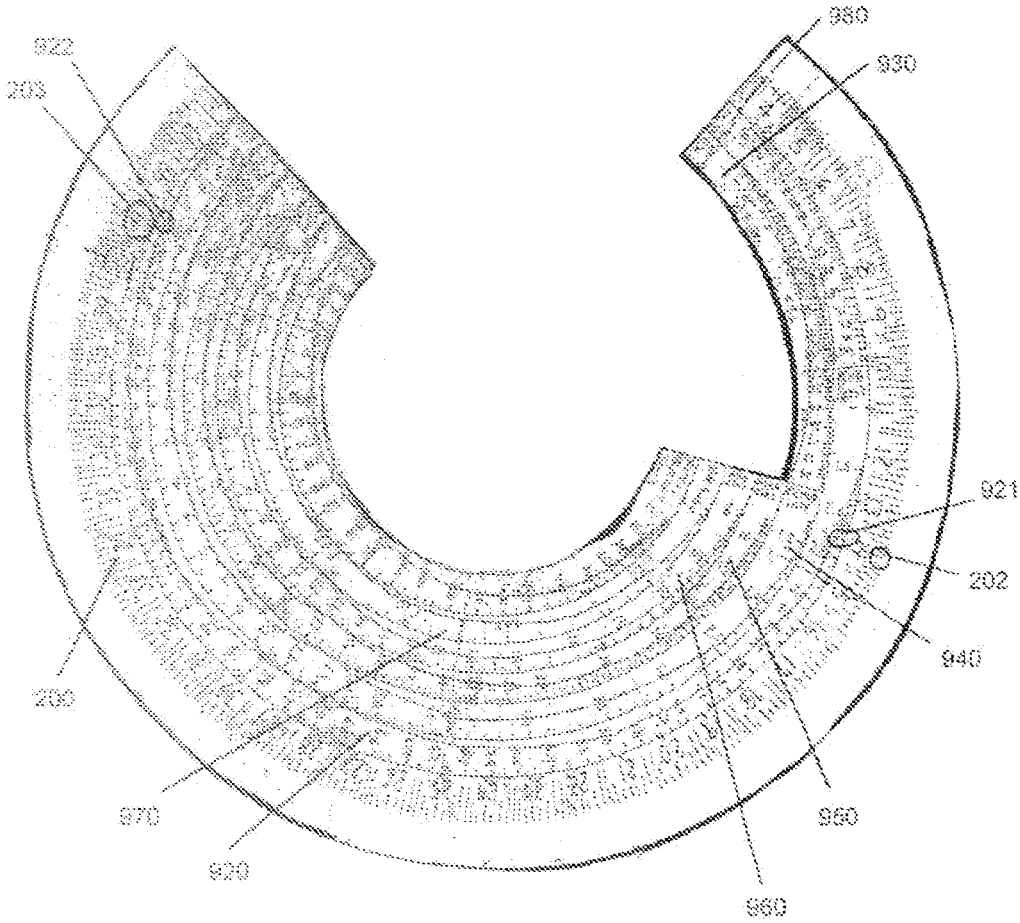
FIG. 9*b*: is a second embodiment showing pregnancy medical tests or ultrasound measurements as continuous variables parallel to the gestational age scale on a gestational plate.

A large number of ultrasound measurements or test results during pregnancy are continuous variables compared to gestational age, with most following smooth growth curves. For instance, the biparietal diameter of the fetal skull (BPD) measured in centimeters increases gradually from approximately 2.0-cm at 13 weeks gestation up to 10.0-cm around the time of delivery. Some pregnancy calculation wheels have intermittent numeric values for pregnancy test or ultrasound measurements printed directly under a corresponding marker for gestational age. However, it would be much more useful for a gestational wheel to contain a more accurate scale of these continuous variables parallel to the gestational age markers. As illustrated in FIG. 9 and FIG. 9B, embodiments of the current invention display pregnancy medical tests or ultrasound measurements (920, 930, 940, 950, 960, 970, or 980) as continuous variables parallel to the gestational age scale (200) on the gestation age plate (500), to accurately display the average value of each variable for any gestational age. Because the gestation age scale (200) on the outer circumference of the gestation plate is a circle, these measurement scales are printed as concentric circles ((920, 930, 940, 950, 960, 970, or 980)) beneath the gestation scale (200), properly aligned for accurate comparison. On FIG. 9*b*, the BPD measurement of 2.3 cm (921) will therefore lie directly below the 14 weeks 0 days marker on the gestation scale (202), and the 10.0-cm measurement for BPD (922) would lie below the gestational age marker for 41 weeks 0 days (203). The BPD scale (920) in between these points would have markers (921) spaced in 1-cm or ½-cm or ⅒-cm increments, depending on the size and accuracy of the scale desired. The mean BPD value for any gestational age can then be viewed on the BPD scale value directly beneath the gestational age value.

Depending on the size and configuration of the pregnancy calculation wheel, several continuous variable measurement scales can be printed on the same gestational plate (500) as a series of concentric circles. Measurement scales can be included for fetal crown-rump length (CRL) (930), biparietal diameter (BPD) (920), femur length (FL) (940), head circumference (HC) (950), abdominal circumference (AC) (960), head circumference to abdominal circumference ratio (H/A ratio) (970), gestational sac diameter (980), cerebellum diameter, interocular distance, serum β-hCG level, and many others.

In another embodiment of the invention and as illustrated on the gestational plate in FIG. 7, several tests and significant dates that may occur at various time periods during a pregnancy are positioned in parallel with the corresponding gestational ages on the gestational plate denoting appropriate times for the tests to take place. The tests in this particular embodiment include but are not limited to Bio-Chemical Screen (720), CVS (721), Nucal Translucn (722), Amniocentesis (723), Tri Screen AFP (724), Level II Ultrasound (725), Early Viability (726), GTT RPR H/H Ab Screen (727), Rho Gam if Rh-neg (728), CBC (729), GC Hb A1C (730), Term (731), Due Date (732), and Post Term (733).

Transparent Marker Arm Plate

As illustrated in the embodiment of the invention in FIG. 4B, a radial line (601) printed on a rotating transparent plate (600) above the gestational plate as a marker arm can be used to increase the accuracy of reading the above measurement scales. By rotating the transparent plate (600) until the radial line (601) is aligned with a specific gestational age (210), an accurate determination of the measurements associated with that particular gestational age (210) can then be read at the point where the line crosses the measurement scale (602). By extending the line through concentric scales (920, 940) a number of measured variables (921, 941) can be read simultaneously for any gestational age.

The usefulness of a transparent marker arm can be further expanded by a number of other embodiments of the current invention as discussed below.

Figure 6:
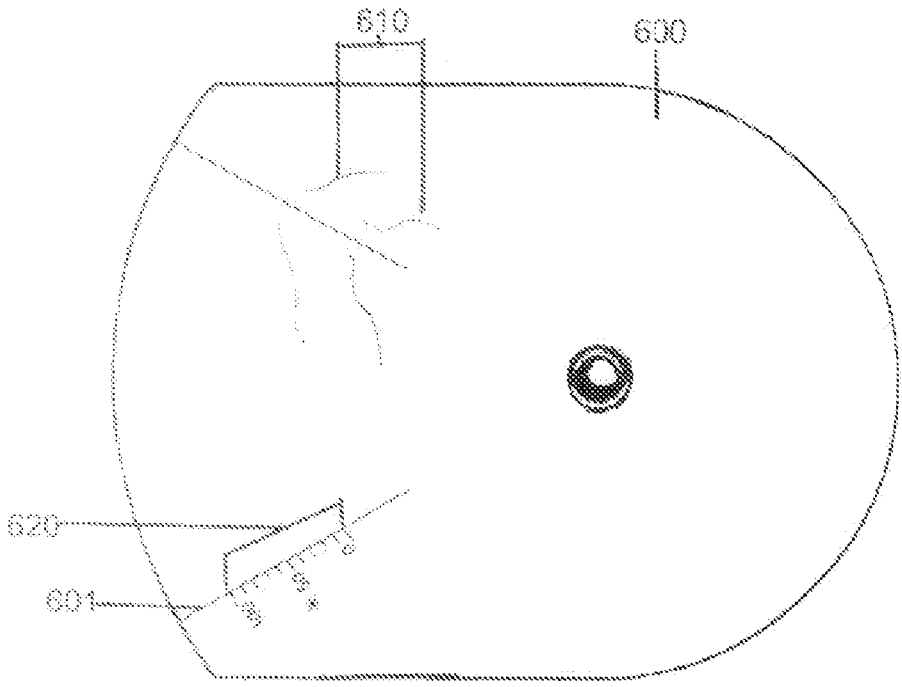
FIG. 6: shows a transparent marker plate with a marker arm with a probability scale and a marker arm with standard deviation lines.
Figure 7B:
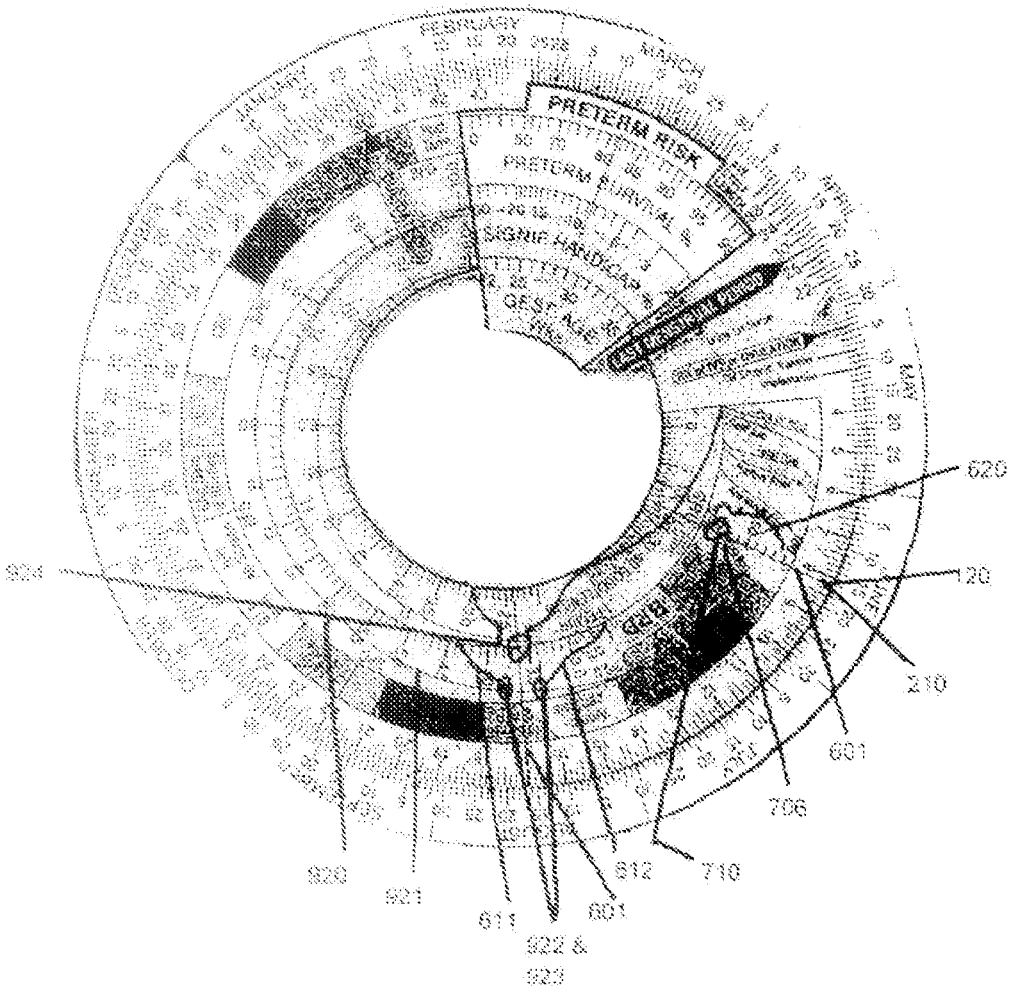
FIG. 7B: shows a gestational wheel calculator illustrating the method of using the y-axis marker on the transparent marker plate from FIG. 6 with the gestational wheel and calendar wheel to determine the probability of viewing various items with an ultrasound.

Looking at FIG. 6 and FIG. 7B, the normal range, error range, or standard deviation of any measurement scale can be printed on the marker arm as two lines or curves (610) lying on each side of the radial center line (601). The center line (601) is used to determine the mean measurement compared to gestational age (210), and the lines (610) on each side of the center line are used to determine the variation of the measurement in question. For instance, the first standard deviation for BPD is represented by a curve (611 and 612) on each side of the center line (601) printed on the transparent marker arm plate (600). The standard deviation lines (611 and 612) will then cross over a separate line (921) printed above the underlying BPD measurement scale (920). The crossover points of the two lines lie directly above the BPD values representing one standard deviation above (922) and one standard deviation below (923) the mean value (924). Because the measurement scale lies within a circular band of a certain thickness, the reference line printed on the gestation measurement scale can begin at the outermost portion of the band near the lowest gestational age value, then continuously descend through the band as gestational age increases until it reaches the innermost portion of the measurement band at the highest gestation age value. The standard deviation or error range measurement curve (611 and 612) on the transparent marker plate above would then be plotted from known standard values as the marker arm is moved radially from the lowest to the highest gestational age. Printing the reference line on the gestation plate and the error range line on the transparent marker arm plate with the same color, for instance red, and printing the center line mean value in a different color, for instance black, would allow easier reading of the mean and error range values. If two variable scales lie at the same radius but occupy different ranges of gestational age, separate colors can be used for the associated reference and error lines to prevent confusion. Because some measurements occupy the entire nine month range of gestational age and therefore approximately ¾ of the circumference of the pregnancy calculation circumference, the reference line can be broken into different segments each descending and ascending across the measurement scale band, with different color printing for each segment. This increases the accuracy of the error range curves printed on the transparent plate above. The mean value and normal range for any ultrasound measurement or pregnancy medical test can then be easily determined at a glance once the gestational age marker is properly aligned.

The Y-axis scale can be printed on the transparent marker arm which can then be moved along any corresponding table or chart on the underlying gestational plate to allow easy reading of the chart values (when using gestational age as an "X-axis"). An example of this method would be the probability measurement (620) of the ultrasound fetal development landmark table as described in FIG. 7*b* and above. This concept can be extended to any other two variable chart or table, with the X-axis consisting the gestational age, and the Y-axis corresponding to the variable in question plotted on the table or chart. By rotating the Y-axis marker to the associated gestational age and calendar date, the plotted Y-axis value could then be read directly off the Y-axis scale for any gestation age value.

As described above and in FIG. 10, the sperm survival curve (1030) for timed intercourse or insemination can be plotted on the marker arm (1000), and then positioned over the associated survival curve for the oocyte after ovulation (410) in order to determine the probability of achieving pregnancy from these events.

Additional information or calculations expressed by two variables can be displayed by mixing primary colors (red, yellow, blue) printed on the transparent marker arm plate with primary colors printed on the underlying gestational plate, resulting in the formation of secondary colors (green, purple, orange) when these plates overlap. For instance, translucent secondary colors can be used to mark positions ahead or behind the center line of the transparent marker arm, with each color corresponding to appointment times for medical or obstetrical visits. As an example, if the center line of the marker arm is positioned on gestational age 16 weeks 0 days, various combinations of yellow, blue, and red printed on the transparent plate above and on the gestational plate below will form spots of secondary colors, with purple positioned at 17 weeks 0 days gestation, orange at 18 weeks 0 days gestation, and green at 20 weeks 0 days gestation. This could correspond to prompting a rapid return obstetrical visit at 17 weeks gestation for a complicated pregnancy, a less rapid return two weeks later at 18 weeks gestation for a less complicated pregnancy, or a routine return obstetrical visit four weeks later at 20 weeks gestation for an uncomplicated pregnancy.

Messages, diagrams, or gimmicks can be produced by alignment of pixels or colors printed on the transparent marker arm and on the gestational plate. The pixel patterns appear nonsensical or random individually, but once properly aligned combine together into a recognizable pattern. For instance, once the marker arm is rotated to position the center line at eight weeks gestation, the pixel alignment could form a message advertising the use of prenatal vitamins to be prescribed at that time.

The pixel concept can incorporate primary colors (red, yellow, blue), so that a recognizable pattern or message made of secondary colors forms at a predetermined alignment between the marker arm and gestational plate. Alternately, hidden and revealed messages, graphics, and notations can be produced by printing colored text or diagrams on the base plate, then overlaying a field of the same color or a contrasting translucent color on the transparent plate above. Green colored text would be difficult to read under a field of translucent green shading printed on the overlying plate, but the same green text would be easily seen under a clear transparent or a translucent red field. Conversely, the text and field printing could be switched on the plates, with colored text printed on the transparent plate above and the field color printed on the underlying base plate. The hidden and revealed system could be used for calculation functions. For example, moving the gestational plate marker to higher gestational age positions could move a colored field to obscure a decimal printed in a numeric label on a graph, and simultaneously reveal a new decimal position in the same label. This expansion of numeric range would allow extension of measurements and calculations to several orders of magnitude for certain applications.

A second transparent independently rotating marker arm can be mounted directly above the first marker arm to allow even more alignment combinations, or allow reading two sets of variables simultaneously. For instance, two transparent marker arms can have their center lines positioned at different gestational ages, with the distance between gestational ages rapidly determined by reading a scale printed on one of the markers. As an example, the amount of time between 8 weeks 3 days gestation and 41 weeks 5 days gestation can be very rapidly determined in this manner.

The second marker arm concept can be further extended to the backside of the gestational wheel calculator. A marker arm on the front of the calculator can be physically joined to a marker arm mounted to the back of the calculator beyond the rim of the calendar plate. The arms are then moved rigidly in tandem, and this method can be used to convey information from one side of the calculator to the other. By locking the movement of other plates of the calculator in various combinations, this method can be used to further enhance the information alignments or calculation abilities of the device. For instance, the gestational plate on one side of the calculator could be fused with a similar rotating plate on the opposite side of the calculator by a device surrounding the center pin. These two plates would then move together as a unit on each side of the calendar plate. If the marker arms on both sides of this device are joined together, alignment information from the gestational plate on one side could be conveighed to the other side.

Information can be printed on the transparent marker arm to allow rapid determination of the amount of time before or after the center line for events printed on the gestational plate. For instance, integers printed at positions one week apart on the transparent marker arm can be used to rapidly determine the number of weeks before or after the gestation or calendar day aligned at the center line. For example, if the center line of the marker arm is aligned with gestational age 12 weeks 0 days, then the number one would lie at 13 weeks 0 days, the number two at 14 weeks 0 days, etc. A level two ultrasound could then be scheduled six weeks after the marked position, because the numeral "6" lies over the region labeled "level two ultrasound" on the gestational plate.

As illustrated by FIG. 2*b*, weekday symbols can be printed on the gestational, calendar, or marker arm plates, and then can be rotationally aligned with calendar days or gestation days beneath. Once a weekday marker is aligned for the specific date of interest, all other calendar dates are automatically aligned with their associated weekdays. This device could be used to schedule specific appointments or tests on days other than weekends, or could be used to schedule specific events such as surgeries on Fridays only. The labels used for the weekday scale could be letters (S, S, M, T, W, T, F, S, S . . . ) or simple symbols with the same repeating pattern every seven days (IIII+IIII . . . ).

Quarter Year Window

Human gestation is approximately nine months in duration, however, the gestational calculator circumference encompasses a full calendar year. Therefore, only approximately three-fourths of the gestational plate (500) surface area is occupied by pregnancy information. As illustrated in FIG. 3, this leaves one-fourth of the gestational surface area plate (2000) available for other purposes. This additional space (2000) may be used for promotions, advertisements, or information tables printed directly on the gestational plate (500). However, it would be an improvement if even more space was available. The portion of the calendar plate underneath the gestational plate is blank space, but this space could be put to use if it were visible. An embodiment of the invention of this application incorporates the use of a large amount of additional surface area on the calculator for information or promotional use by installing a transparent window or a hole cut (2002) into the unused space on the gestational plate. This allows the blank space of the calendar plate to become visible. A transparent window (2002) would be more useful than a simple cut out because additional alignment lines (2006), scales, or information could be printed on the transparent portion to enhance use of the information printed beneath on the calendar plate. The greatly extended surface area now available on the calculator can be used for a variety of different purposes, including the following.

Information scales for two variables printed on the calendar plate in radial fashion can be viewed through the transparent window, with accuracy of the information improved by using a center line printed (2006) on the transparent window (2002). The width of the scales can be very narrow, with one to several tables crowded into the one-fourth year space visible through the window. Larger tables can be extended beyond the limits of the transparent window, and can be accessed by rotation of the window over a greater radial distance. Some tables may even occupy the entire 360 degree space and can be accessed with one-fourth of the scale or table visible at any one time. Any two variable relationship can be displayed in this manner, and multiple scales can be used concentrically together.

Figure 5:
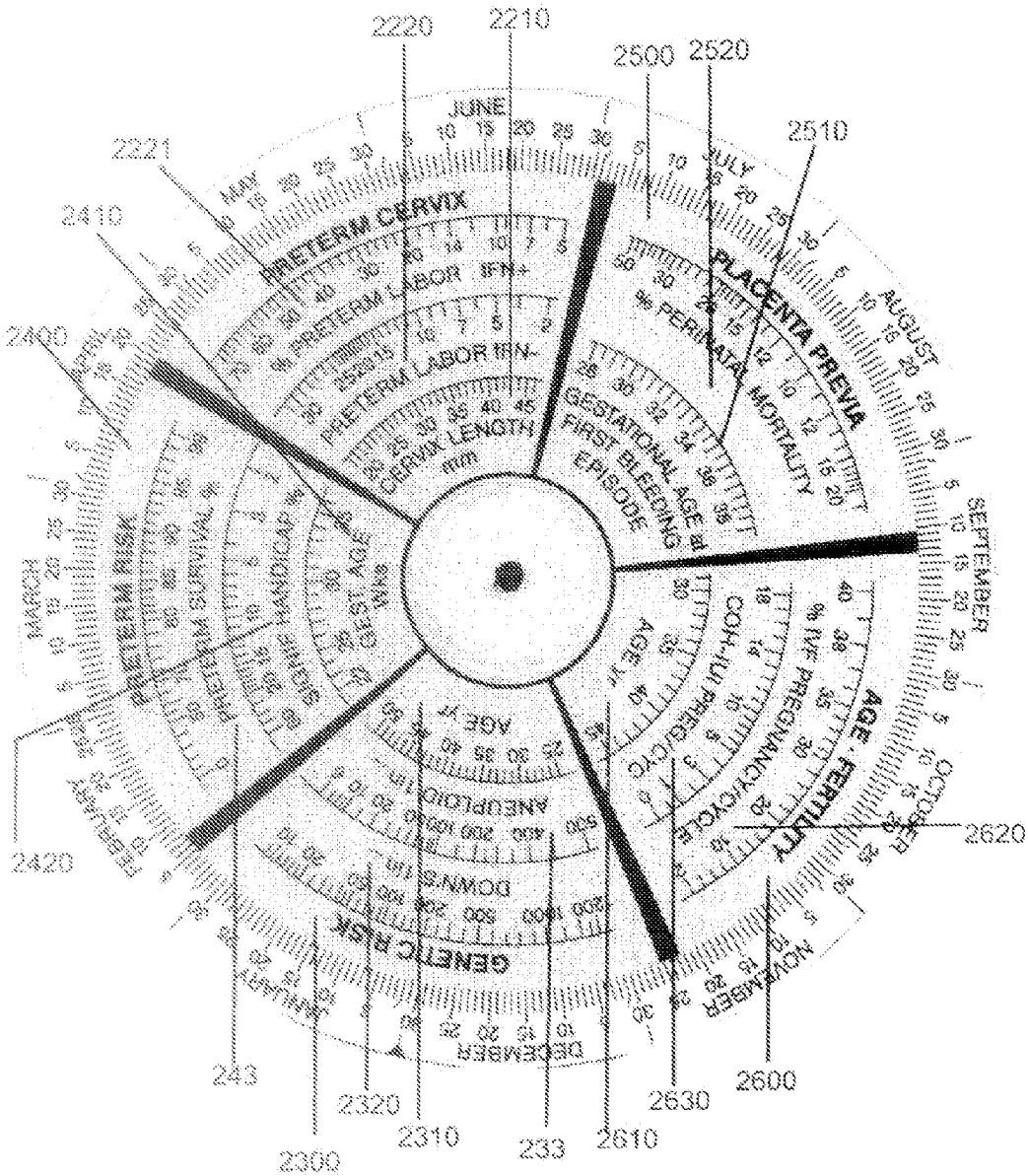
FIG. 5: shows several scales from the center section of a calendar plate of a gestational wheel calculator which are usually only exposed in sections through a quarter year window

An example of information that can be viewed through the quarter year window (2002) is illustrated by one embodiment of the invention in FIG. 5 where scales for ultrasound measurement of the length of the cervix (2210) can be aligned with scales for the risk of premature labor and delivery (2220), so that when the center line (2006) is positioned on a cervical length measurement (2201), the risk of preterm labor (2221) can be read directly off the cernter line position on the risk scale (2220).

FIG. 5 illustrates another embodiment of the invention where a Genetic Risk calculator (2300) may be viewed through the quarter year window (2005). The Genetic Risk Calculator (2300) includes a scale for the age of the mother (2310), which can be properly aligned with a scale for the risk of Down's syndrome (2320) associated with maternal age and with a scale for the risk of aneuploid chromosome defects (2330) associated with maternal age.

FIG. 5 illustrates another embodiment of the invention where a Preterm Risk calculator (2400) may be viewed through the quarter year window (2005). The Preterm Risk calculator (2400) includes a scale for the gestational age of the fetus (2410), which can be properly aligned with a scale for the risk of significant handicaps (2420) and with a scale for the likelihood of preterm survival (2430).

FIG. 5 illustrates another embodiment of the invention where a Placenta Previa plate (2500) may be viewed through the quarter year window (2005). This calculator includes a scale for the Gestational Age at the First Bleeding Episode (2510), which can be properly aligned with a scale for the percent likelihood of Perinatal Mortality (2520) in order to determine the percent likelihood of Perinatal Mortality.

FIG. 5 illustrates another embodiment of the invention where a Age/Fertility plate (2600) may be viewed through the quarter year window (2005). This plate includes a age of mother scale (2610), which can be properly aligned with a % IVF Pregnancy/Cycle scale (2620) and a COH-IUI PREG/CYC scale (2630).

Tables, calendars, photographs, etc. Information other than marked variable scales can also be printed on the calendar plate and visualized through the transparent window. Examples include tables such as scoring systems used to determine the Apgar or the cervical maturity bishop's score. Calendars can also be printed, with these calendars aligned with the calendar scale printed at the periphery of the calendar plate. For instance, promotions for Thanksgiving or Christmas can be printed directly below the appropriate dates on the calendar scale, and these promotions can then become visible once the transparent window lies directly below those calendar dates. Other items visible through the window include photographs, logos, and maps. Promotional and commercial advertisements can be printed on the calendar plate and viewed through the transparent window to increase the marketing value of the invention.

An aligned table or graph can be printed on the calendar plate, with the means of precisely aligning this table with the transparent window on the gestational plate. Once this is done, the calendar plate becomes an extension of the gestational plate, and additional information that is at a fixed position compared to gestational age is now available for use. This concept can be further extended by use of the transparent marker arm above, with this arm positioned so that a marker on one part of the transparent arm aligns with a pregnancy event, and a second marker overlying the transparent window of the calendar plate is then precisely aligned with information printed on the calendar plate below. For example, a radial marker on the marker arm aligned over the first trimester of pregnancy can be used to transmit information through a separate marker positioned over the calendar base plate with a scale to determine the normal range of the β-hCG hormone level corresponding to that particular gestational age.

A custom calculator can be devised by printing linear or log scales on each component. A log scale printed on the transparent window can be aligned with a separate log scale printed on the calendar plate below allowing for multiplication and division with the result listed at a separate spot in the window. Customized log scales can be used to calculate specific algorithms, such as Body Mass Index or Body Surface Area, or can be used to calculate ratios such as Head Circumference/Abdominal Circumference Ratio. In similar fashion, linear scales can be used for basic subtraction and addition, for instance adding Apgar components to determine the final Apgar score.

Gestational Plate Extension

Figure 13:
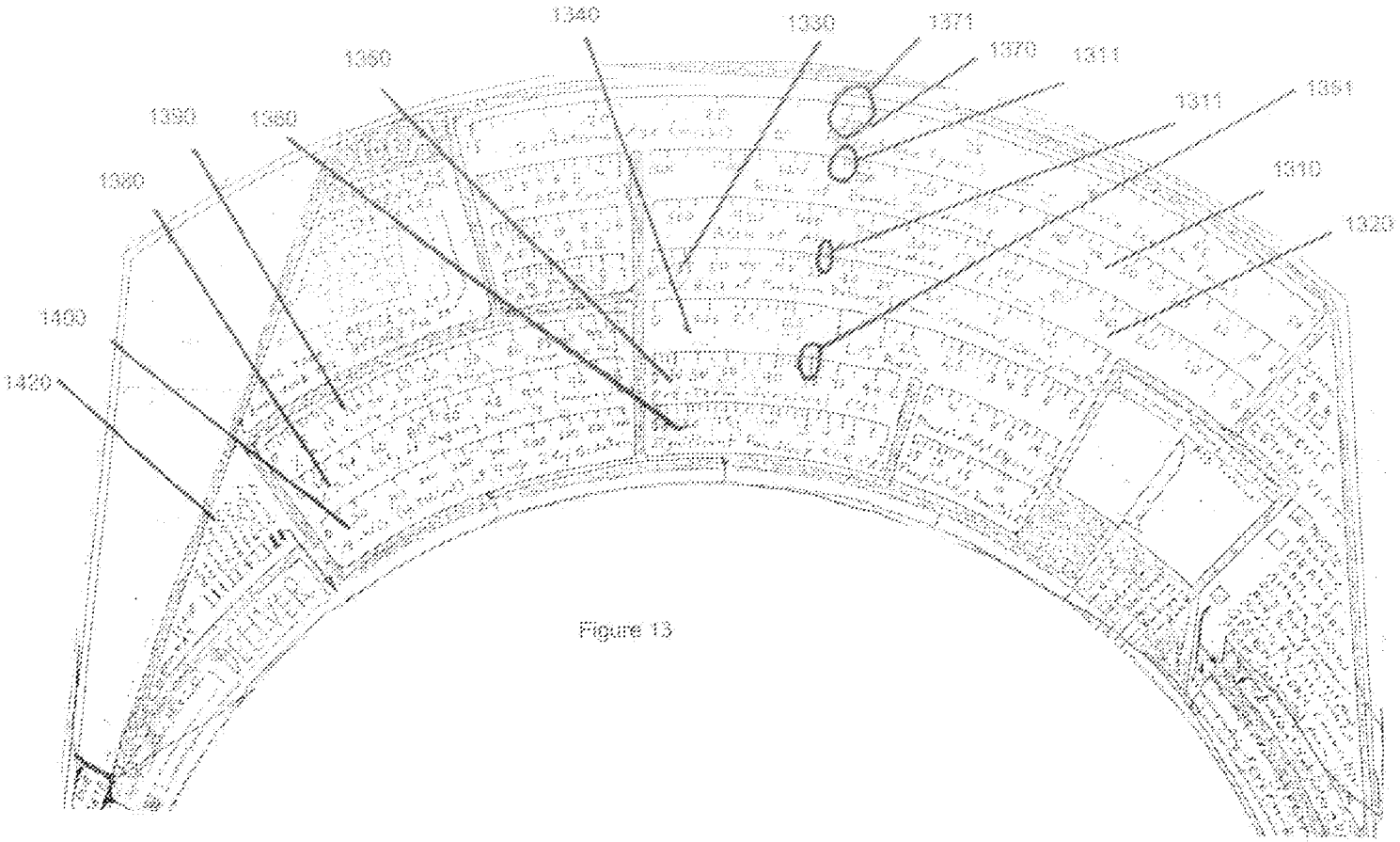
FIG. 13: shows an embodiment of a gestational plate which contains an extension for displaying several risk scales based on gestational age, patient age, and cervix length.

In addition to using a "quarter year" window to gain additional space on a gestational wheel, another option is illustrated in FIG. 13. In this embodiment of the invention, the gestational plate is extended at the top to include several concentric circle scales. These scales include Risk of Down's Syndrome scale (1310), Risk of All Aneupladies scale (1320), Percent risk of Pre-term Delivery (from Ultrasound Cervix Length) Scale (1330), Pre-Term Survival Scale (1340), Significant Handicap Risk Percentage Scale (1350). All of these scales align with the same numeral values from gestational age, patient age, and cervix length scale which is the top concentric circle scale to determine their results. For example, when the top scale reads 30 (1371), it could mean 30 gestational weeks which means that the corresponding likelihood of pre-term survival is 95% (1351) from the Pre-term survival scale. When the top scale reads 30, it could also mean that the patient is 30 years of age. This corresponds to a one in 800 risk (1311) of Down's Syndrome from the Risk of Down's Syndrome Scale. When the top scale reads 30, it could also mean the patient has a Cervix Length of 30 mm. This corresponds to a 34% chance (1331) of Pre-term delivery from the Percent risk of Pre-term delivery (from Ultrasound Cervix Length) Scale.

In another embodiment of the invention, the gestational plate extension contains a set of scale to determine the Percent Probability of Ongoing pregnancy for patients under the age of 40 (1380) or over the age of 40 (1390) based on the β-hcg level at four weeks two days gestation (1400). For example, if the β-hcg level at four weeks two days gestation is 100 mIU/ml, the corresponding percent probability of ongoing pregnancy for a patient under age 40 is 60% and for a patient over age 40 is 20%.

An overlay of marker (1001) from the transparent marker plate (1000) illustrated in FIG. 2B also greatly assists in interpreting and aligning the values in the concentric scales.

The gestational plate extension illustrated in FIG. 13 also contains a weekday scale (1420) which can be aligned with calendar plate (100) shown in FIG. 1*b* to assist in determining what day of the week a particular date is without having to continually consult a present year calendar.

Rotating Plate on the Back Side of the Gestational Calculator

Only one side of the gestational calculator is needed for all the basic functions and displays described above. This leaves the other side of the calculator available for other useful purposes. Some calculators leave the back side blank or use the space to print promotions or advertisements. Occasionally, a graph or table related to pregnancy or to the use of the advertised item, such as a pharmaceutical dose table, is printed on the back side.

Aside from gestational calculating wheels, a number of other simple calculating devices are used by physicians, technicians, and the general public. For instance, in the medical field linear slide rule or circular slide rule like calculators are used to determine body mass index or body surface area from a patient's height and weight measurements. This is done by using customized logarithmic scales which are designed to solve specific algorithms. Some additional information or calculating power would be desirable, especially for medical personnel or if it related to pregnancy. An embodiment of the current invention supplies that additional information and calculating power by placing additional calculation capacity on the back of the gestational wheel, thus avoiding the need for separate calculating devices.

The following "back side" information and calculation devices are incorporated in various embodiments of the current invention.

Rotating plate with transparent windows. As with the Quarter Year Window (2002) on the "front side" of an embodiment of the invention described above, the useable surface area on the back side of the calculator can also be nearly doubled by installing a rotating plate containing one or more transparent windows permitting information on the base plate beneath to be viewed, along with information printed on the rotating window plate itself. This allows nearly twice as much advertising, promotional, or marketing material to be displayed and also allows pixel alignment or primary color mix items to be included.

Two variable algorithm solution. A scale axis printed alongside a transparent window can be rotated over a graph below, enabling a properly designed system to solve most two variable algorithms. The algorithm solutions are printed on the base plate beneath as a mathematical "contour map." When a marker on the top plate is aligned with the X-axis value on the base plate, the "Y-axis scale" on the window plate automatically lies above the associated "Z" solution. For example, a frequently required calculation in obstetrics is Estimated Fetal Weight (EFW). Algorithms for determining estimated fetal weight typically require two ultrasound measurement variables, most commonly abdominal circumference "X" (1120) and BPD "Y" (1130), or alternately abdominal circumference and femur length (1140). In one embodiment of the invention illustrated in FIG. 11, the estimated fetal weight solution for each combination of the values of X and Y can be printed on a rectangular chart with sides of X-axis and Y-axis and solution as a "contour map" of Z values (110*a*, 1110*b*). When converted to radial form, the Y-axis can be rotated over the contour map to align with any X value, and the Z value solution (1110) can be read beneath the Y-axis scale on the solution map. For instance, if the X-axis marker (1121) is aligned with fetal abdominal circumference of 26 cm (1122), the Y-axis scale upon which values of femur length are printed (ranging from 2.0 to 10.0 cm) (1140) will automatically lie on top of a contour chart plotting the associated estimated fetal weights (1110*a*). If the ultrasound measurement for abdominal circumference was 26.3 cm (1123), and the femur length was 7.6 cm (1141), then the contour map line for EFW of 2350 grams (1111) would cross the femur length axis (1140) at that point.

Figure 11:
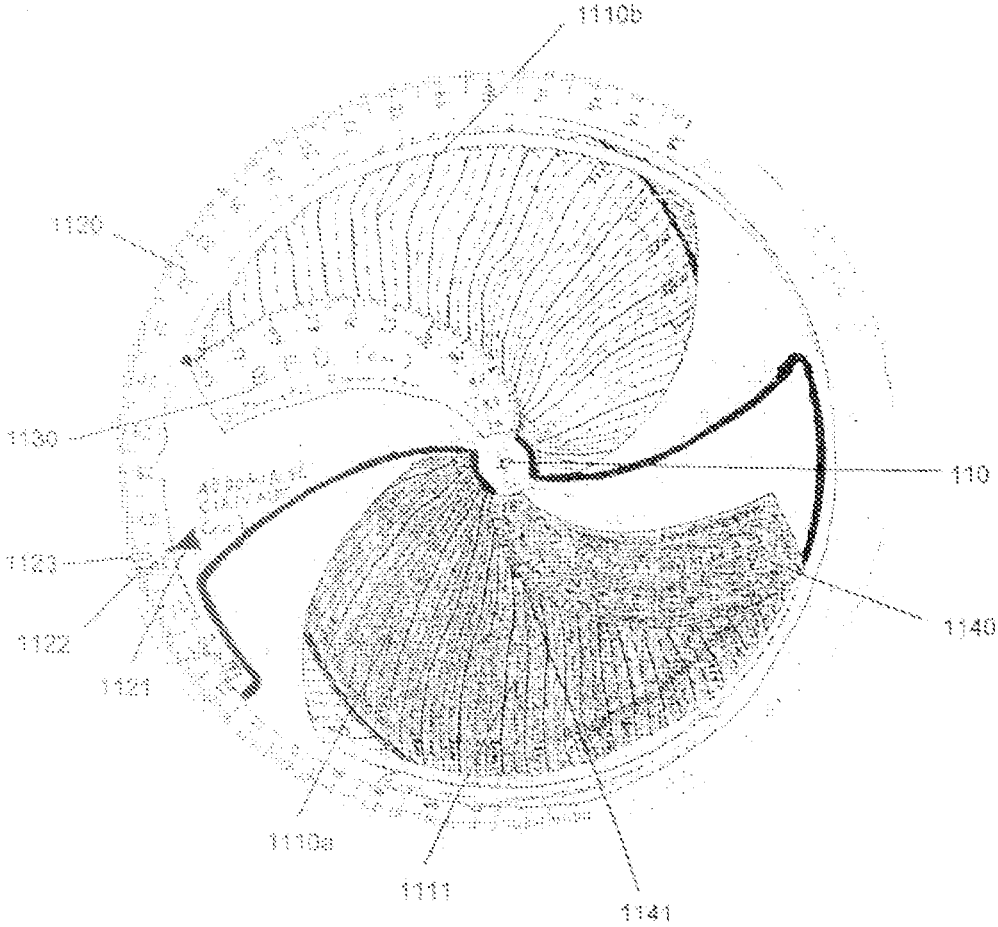
FIG. 11: shows a method of calculating estimated fetal weight based on Abdominal Circumference and BPD or Femur length.

Many two variable contour map solutions can be printed on a parallelogram instead of a rectangular X/Y chart, because low X values may be associated with low Y values and high X values may be associated with high Y values. Low X values would not be associated with high Y values, etc. For instance very low fetal abdominal circumference is never associated with very high femur length, so the part of the contour plot in this range is unnecessary and can be left blank. This observation allows further extension of the X-axis solutions on the rotating calculator on the back side of the gestational wheel, and can even be used to plot two contour maps, one for femur length values and one for BPD values, with the X-axis occupying more than 180 degrees of circumference. These two contour maps are also illustrated in FIG. 11 and are labeled 111*a* and 1110*b*.

Figure 12:
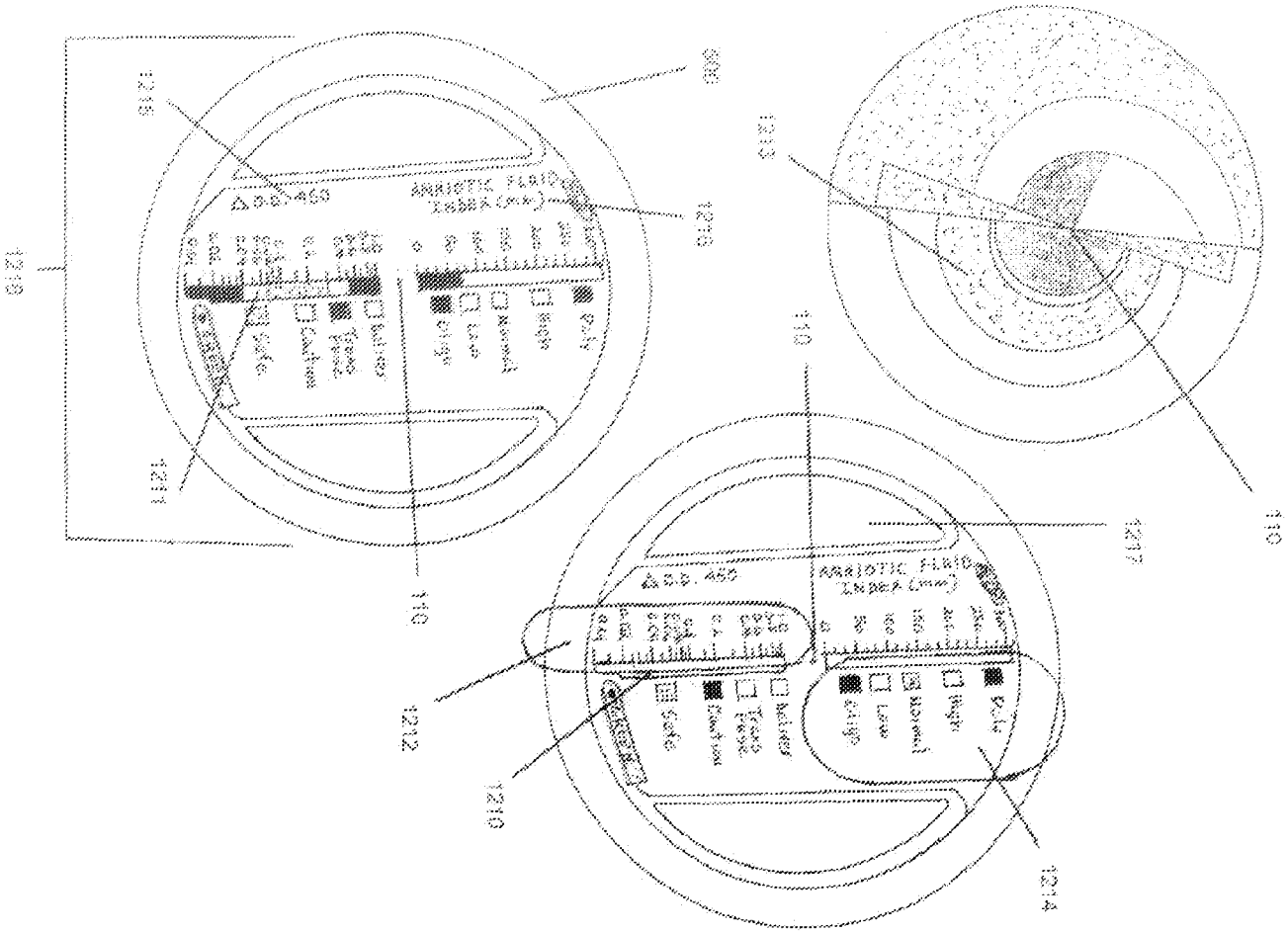
FIG. 12: shows the different layers of a gestational wheel used to create a OD-450 test

For some applications, a variation of the two variable algorithm innovation described above would allow easier reading and less confusion. This method as illustrated in FIG. 12 would entail narrowing the width of the transparent window (1210) on the rotating window plate so only a small strip (1211) of information or data on the base plate below could be viewed at any one time. The desired solution to rotating window scale applications lies only at the juncture of the measurement scale (1212) along the side of the transparent window, and the "z" value lines printed on the base plate below (1213), so theoretically only a narrow slot of transparency is required alongside the "Y" value scale on the rotating plate. With this method, however, numeric values for "Z" would be difficult to read through a narrow slot, so other easy to use methods such as color coded value ranges can be used on the base plate solution map (1214).

Figure 12B:
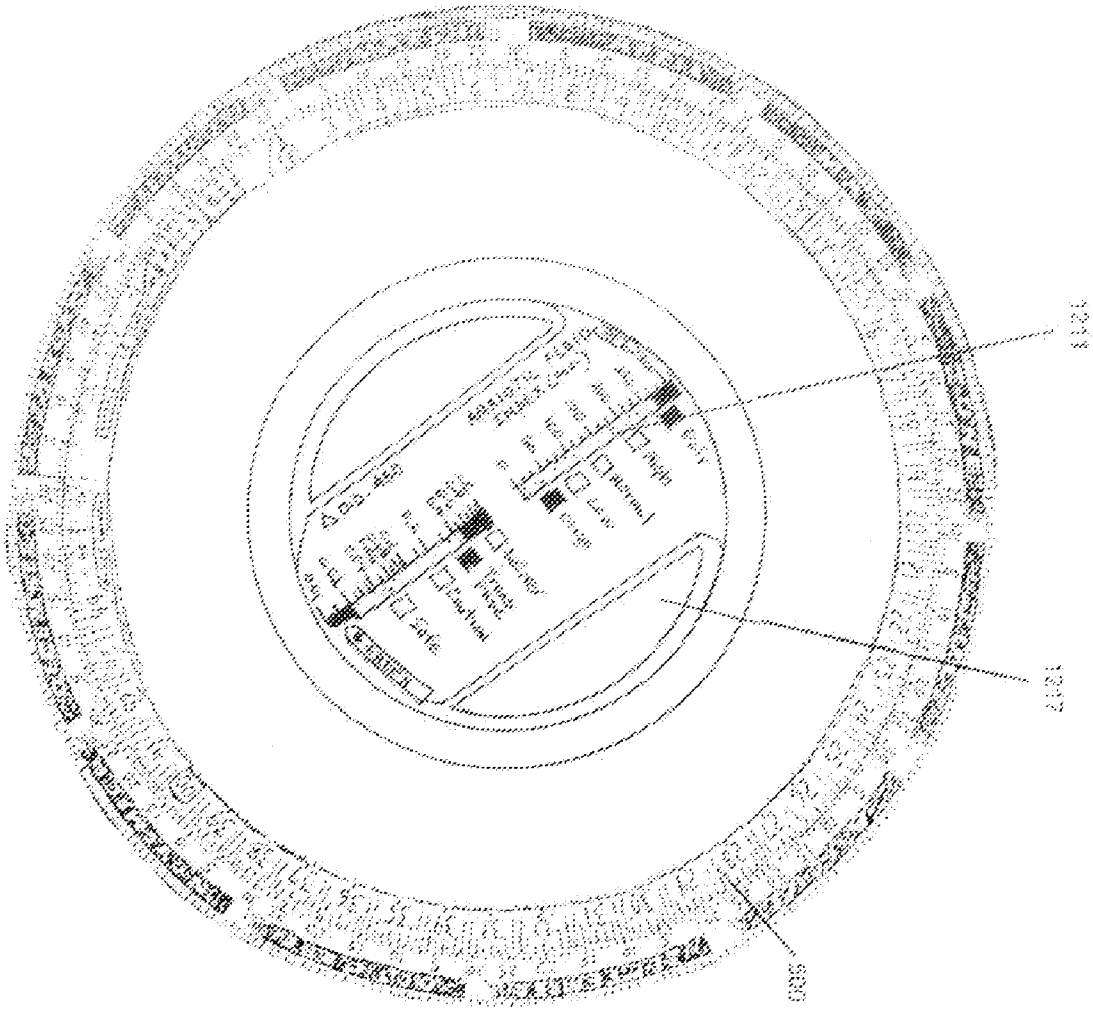
FIG. 12*b*: shows the layers of FIG. 12 and where they would be located on a gestational wheel

This method is especially suited for non-algorithm applications, such as observational data. For example, a test used to determine the degree of severity of fetal anemia during pregnancy is called the "delta OD-450 test", which measures light absorbance of amniotic fluid at the spectrographic 450 frequency. The severity of anemia depends upon the delta 450 value, but the clinical implications for re-testing, continuation of pregnancy or emergency delivery are dependent upon the gestational age of the pregnancy in addition to the delta 450 value. As illustrated in FIGS. 12 and 12*b*, a two-dimensional clinical outcome map is commonly used with the delta 450 (1115) on the Y-axis, gestational age (500) on the X-axis, and a pattern of zones for each of these values to represent ongoing pregnancy, re-test time period, or delivery. This pattern can be converted to a radial map, and the Y-axis delta 450 value can be printed alongside a slot window, with each zone represented by a different color visible through the transparent slot on the base plate below. By rotating the slot to the proper gestational age marker, and by reading the delta 450 value along the slot window axis, the associated color code displayed at that axis point will help determine clinical decisions for re-test or delivery. Similar color coded maps can be used to help make clinical decisions based on amniotic fluid index (1116) or other factors which are dependent upon gestational age.

FIG. 12 depicts the different layers required for the delta OD-450 test. Part 1213 is a part of the gestational plate 500, thus remains in constant position relative to the gestational age markers. Part 1217 is a circular overlay that can be a part of or rest on top of transparent marker arm (1000). Part 1218 is a view of part 1217 assembled on top of 1214 as they are connected by and rotate about axis (110). This view is also illustrated complete with the gestational age markings in FIG. 12*b*.

Other specific calculations that can be accomplished with the two-variable algorithm solution discussed above include:

1. Estimated Fetal Weight derived from Abdominal circumference, BPD, Femur Length, Abdominal diameter, Leg and Arm Circumference, and other ultrasound measurements.
2. H/A Ratio (Head Circumference/Abdominal Circumference ratio)
3. Head A/P Diameter ratio (Anterior to Posterior Diameter)
4. Abdominal Circumference/Femur Length Ratio
5. Crown-rump length to gestational sac diameter ratio
6. Body Mass Index
7. Body Surface Area
8. Amniotic Fluid Index
9. Other Calculations Customized scales for algorithms. A customized log scale for patient weight adjacent to a customized log scale for patient height can be used to derive a solution for body mass index.

Menstrual Cycle Calculators

In another embodiment of the present invention a menstrual cycle calculator is provided for use on the backside of the gestational wheel. Other applications require a higher resolution within a 1 to 2 month period of time, so a calendar with more widely spaced days would be useful in these cases. For example, fertility applications typically include a series of diagnosis tests or a series of treatments that are included within a single menstrual cycle ranging from 24 to 35 days length. It would be useful to display the tests or treatments for an individual menstrual cycle once properly aligned with the associated calendar dates. If the calendar dates are less than one-degree apart (when printed on a 365-degree circumference) then the resolution is too low to properly view the test or treatment options or to allow printed labeling of the options to be readily seen. By providing a separate rotating calendar on the back side of the gestational calculating wheel with expanded angular size of each calendar day, the required information can be printed and visualized with much greater ease, and the accuracy of the calculator can also be improved by higher resolution alignment. Dividing the circumference of the back side into a 31-day generic month would be one solution. A rotating plate on top of the base plate upon which menstrual cycle days, tests, and treatments are printed would allow alignment of cycle days with the associated generic monthly calendar day.

Figure 14:
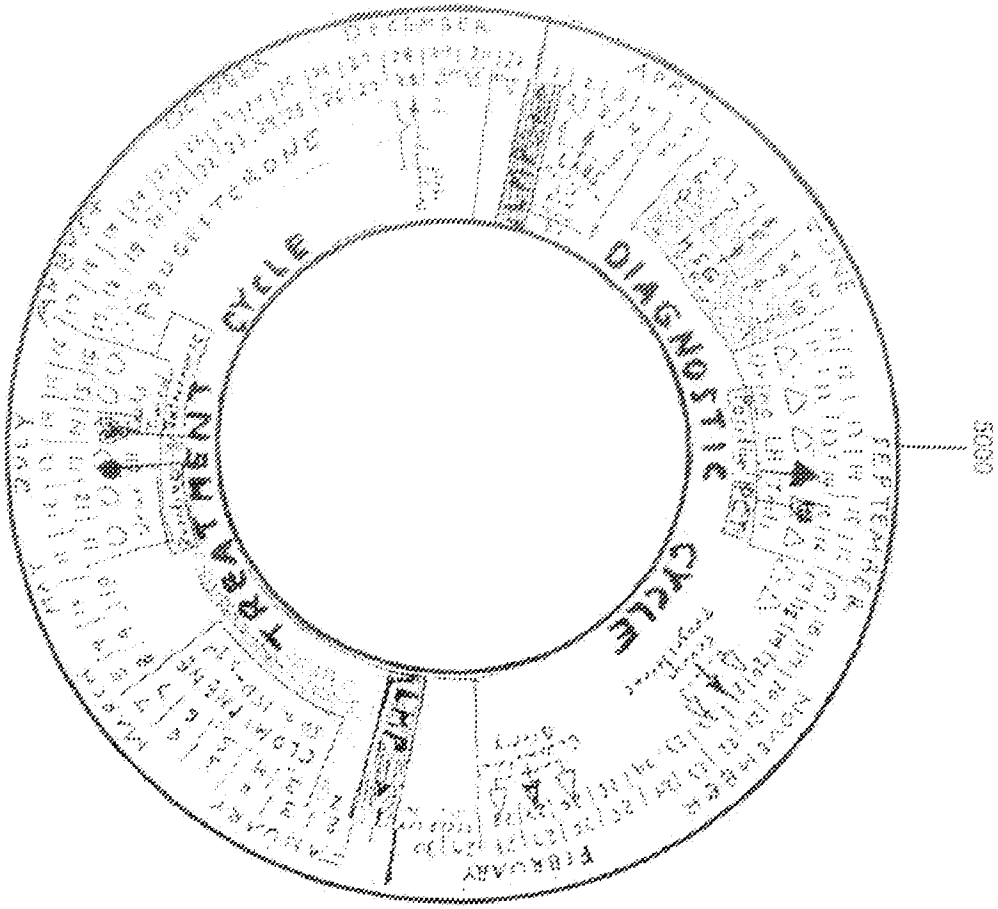
FIG. 14: Menstrual Cycle Calculator Plate.
Figure 15:
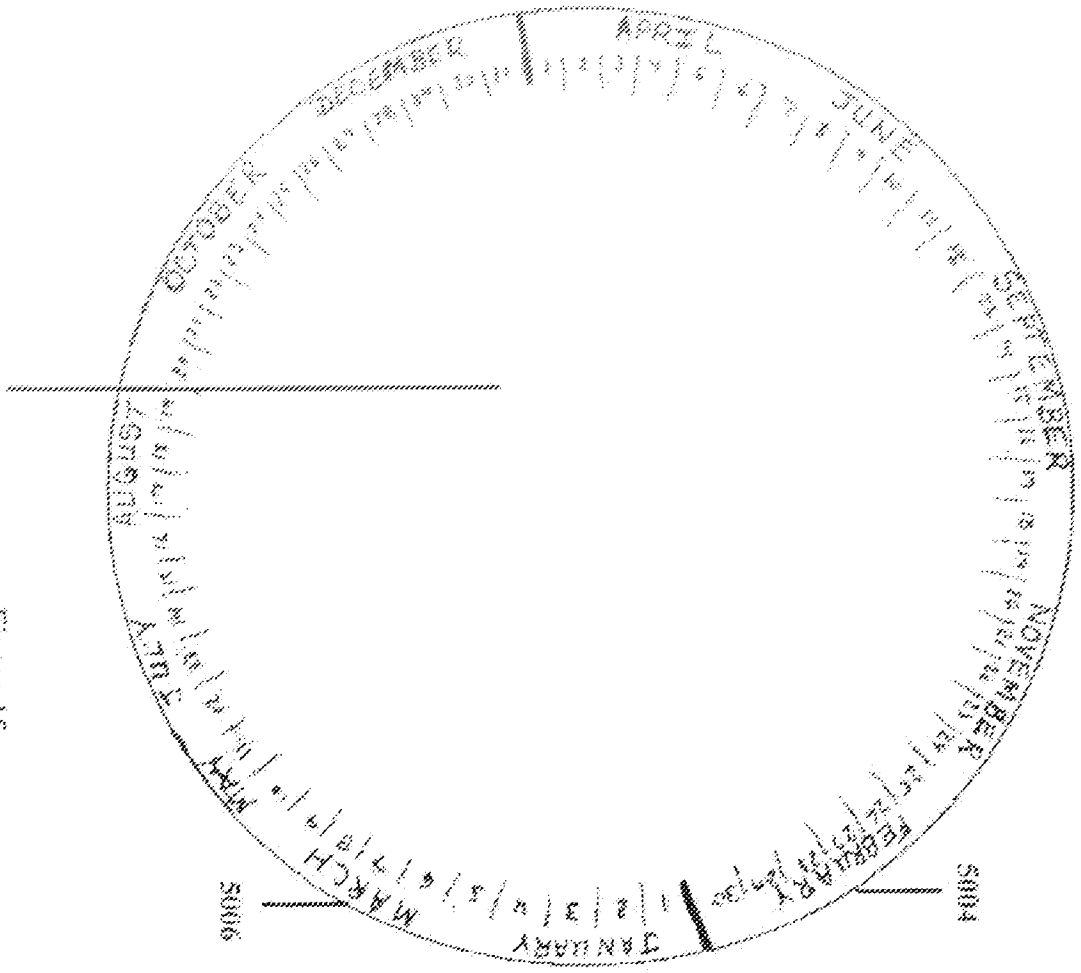
FIG. 15: Calendar plate for Menstrual Cycle Calculator Plate.
Figure 16:
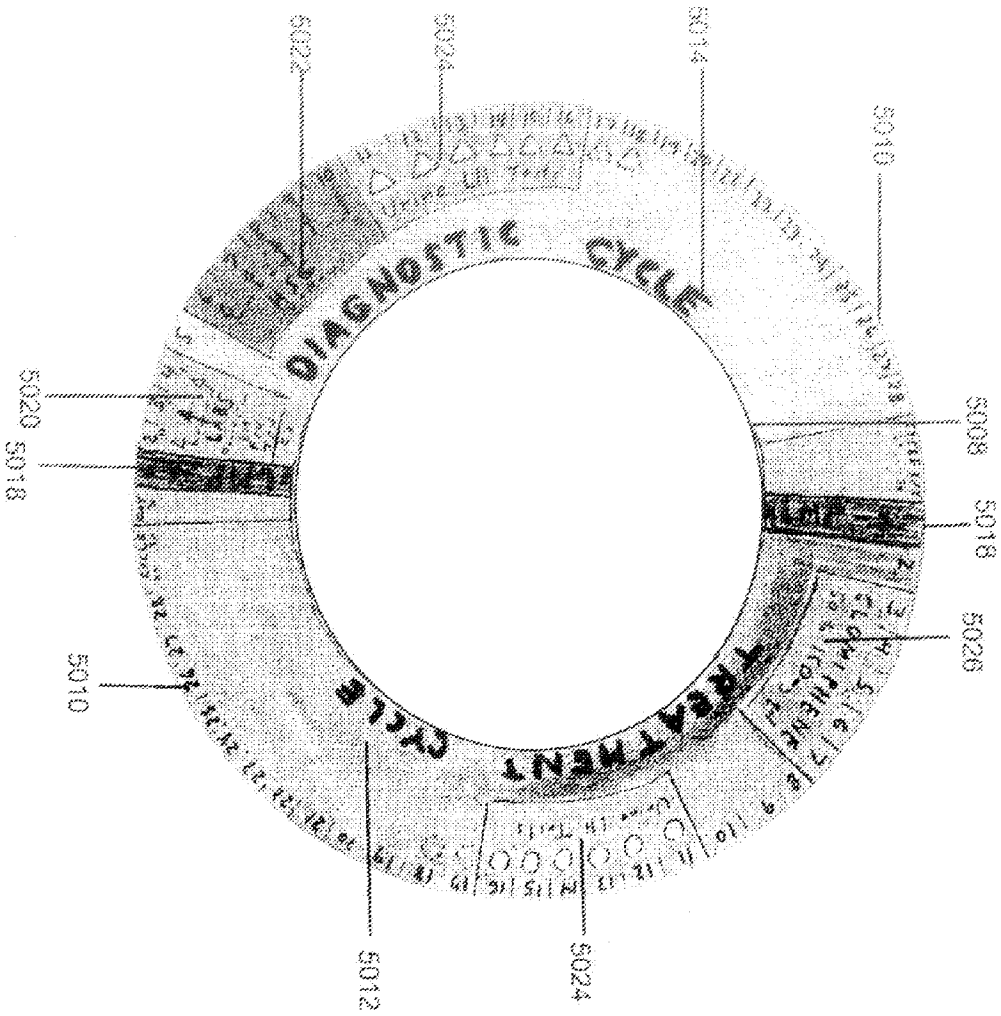
FIG. 16: Top plate for Menstrual Cycle Calculator Plate.
Figure 17:
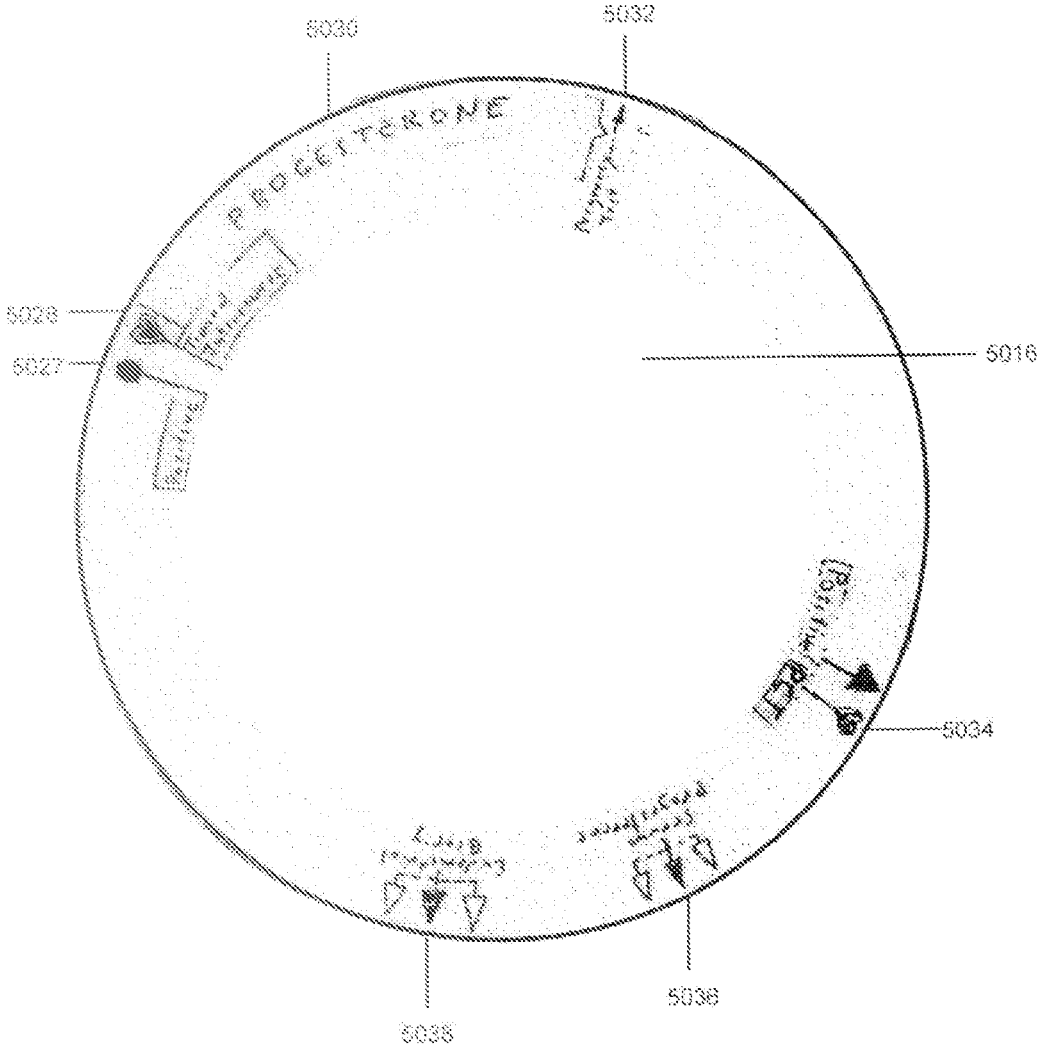
FIG. 17: Transparent plate for Menstrual Cycle Calculator Plate.

FIG. 14 illustrates the menstrual cycle calculator wheel 5000 of the present invention. FIGS. 15, 16, and 17 depict the individual plates of the menstrual cycle wheel calculator. Most menstrual cycles extend over two calendar months, so a generic 31-day month calendar would introduce inaccuracies at the transition from one calendar month to the next because some months have fewer than 31 days. A method to readily solve this dilemma is provided by a 61-day calendar 5002 of FIG. 15 that is divided into two generic months, one of 30 days length 5004 and the other of 31 days length 5006, so the transition from one month to the next could match any calendar transition (except for the end of February). A rotating cycle day plate 5008, as depicted in FIG. 16, is disposed above the 61-day calendar base plate 5002 would also contain 61 equal circumferential divisions 5010 representing cycle days upon which testing and treatment options are printed. Because the average menstrual cycle length is 28 days, it is feasible to print two separate menstrual cycle representations on the rotating plate, and this could allow inclusion of both a treatment cycle 5012 and a diagnosis cycle 5014 on a single plate. In order to use this innovation, the marker printed on the cycle day plate for "first day of menstrual period" or "last menstrual period" would be aligned with the proper calendar day number. For ease of use, the names of the months with 31 days would be printed along the circumferential edge of the portion of the calendar containing 31 days 5006, and the names of the months containing 30 days would be printed above the section of the calendar which contains 30 days 5004. If the patient started her last menstrual period on August 22, then the marker on the cycle day plate would be rotated to the 22 position of the 31-day segment of this generic calendar. Any activities during the cycle after the end of August would be properly aligned with the numeral for the proper calendar date for September. To make month labels easier to identify, an overlying transparent plate 5016, as depicted in FIG. 17, can be used to highlight the consecutive months in use by enclosing the month labels in two printed boxes approximately 165 degrees apart. The position of the boxes on the transparent plate 5016 is coordinated with the month labels on the base plate so that only two consecutive months are highlighted for each position.

Typical items printed for a diagnostic cycle on the cycle day plate 5008 would include last menstrual period 5018, diagnostic laboratory tests 5020 (typically cycle days 2 through 4), hysterosalpingogram x-ray 5022 (typically cycle days 6 through 10), and urine LH testing 5024 (typically cycle days 11 through 16), postcoital test (typically cycle days 14 through 16), midluteal progesterone level (typically cycle days 21 through 23), endometrial biopsy (typically cycle days 25 through 27), and serum pregnancy test (typically cycle day 28 and beyond). Treatment cycle items included on the cycle day plate 5008 would include last menstrual period 5018 (cycle day 1), clomiphene medication 5026 (typically cycle days 3 through 7, or cycle days 5 through 9), and urine LH test 5024 (typically cycle days 11 through 16), timed intercourse (typically cycle days 12 through 18), and progesterone medication (typically cycle days 15 through 28), and pregnancy test (typically cycle day 28 and beyond).

Some diagnostic tests and medical treatments during menstrual cycles are related to menstrual cycle day. However, other diagnostic tests and treatments are dependent upon the day of ovulation, which generally varies between cycle day 11 and cycle day 19. Once ovulation occurs during a diagnostic or treatment cycle, all subsequent tests should be scheduled on a certain number of cycle days following that event. For this reason, the accuracy of a fertility calculating wheel would be further improved by addition of another rotating transparent plate above the cycle day plate and providing information related to ovulation and subsequent tests or treatments. Diagnostic tests printed on this rotating transparent ovulation plate would include a marker for positive urine LH surge which overlies and corresponds to the urine LH test markers placed on the cycle day plate beneath, with additional markers on the ovulation transparent plate for post-coital test (typically one day after positive urine LH surge), serum progesterone level (typically 5 to 7 days after positive urine LH test), and endometrial biopsy (typically 11 to 12 days after positive urine LH surge), and serum pregnancy test (typically 14 days and beyond from the positive urine LH test marker).

Treatments printed on the transparent rotating ovulation plate 5016 of FIG. 17 may include positive urine LH test marker 5027 overlying the markers for urine LH testing 5024 printed on the cycle plate 5008 of FIG. 16 beneath, timed intercourse 5028 (typically one day after positive urine LH test), progesterone medication 5030 (typically extending from two to twelve days after positive urine LH test), and serum pregnancy test 5032 (typically 14 days and beyond from the positive urine LH surge marker). Use of this device would entail aligning the last menstrual period marker 5018 on the cycle day plate with the appropriate calendar day on the base plate 5002, and then once the patient reports a positive urine LH surge test, the transparent ovulation plate 5016 would be rotated over the cycle day plate 5008 until the positive test marker on the ovulation plate overlies the proper calendar cycle day on the plates below. All subsequent tests and treatments for the rest of the cycle will then properly align for the remaining calendar days.

Additional days can be added to the cycle day plate. For instance three generic months can be added, one with length of 30 days, one with length of 31 days, and one with length of 28 days, in order to allow February to be included on the back side calendar calculator. This calendar would have a circumferential length of 89 days. If leap year is included as a fourth month, the circumferential length of the back side calculator would be 118 days. However, each time more generic months are added to the back side calculator, the resolution size of individual days becomes smaller and the subsequent calculator may become more difficulty to use, especially if it is of small diameter.

Log scales for division and multiplication. Linear and circular slide rules are commonly used to solve basic multiplication and division problems, and operate by offset alignment of identical logarithmic scales. A large number of medical or obstetrical calculations depend upon simple multiplication or division, so inclusion of a logarithmic calculator for these functions would be useful on the back side of the gestational calculation wheel. Examples of simple division application would be determination of the head circumference (HC) to abdominal circumference (AC) ratio (HC/AC ratio), or the biparietal diameter (BPD) to femur length (FL) ratio (BPD/FL ratio). Many of these ultrasound measurement values during pregnancy are contained within two orders of magnitude over the duration of pregnancy, for instance abdominal circumference may range from 6.0 to 44.0-cm, so logarithmic scales that cover this magnitude would be most useful for these applications. The "A" and "B" scales on a circular slide rule each cover two orders of magnitude over its entire circumference, and inclusion of an A/B scale circular slide rule would have good general use on an obstetrical calculator.

Once a specific alignment between identical scales has been set, a single ratio is represented along the entire length of the interface between the log scales. For instance, if the log scales are aligned for a factor of 2.6, then all values along the first log scale are equal to 2.6 times the values along the adjacent log scale. Reading the alignment values is often difficult for people who are unfamiliar with scale reading, often from distraction by extraneous information on each side of the value point of interest. For this reason, it is useful to add a transparent window with a center line which can be moved along the log scale and which obscures the extraneous information on each side of the value of interest. This concept can be extended further with two windows separated from each other, each one reading a specific value, with a third transparent window reading the multiplication or division solution. For instance, one window could be aligned on top of the abdominal circumference value; another one could be aligned on top of the head circumference value, with the third window lying on top of the H/A ratio solution. This method would require a third rotating plate lying above the base plate and the log scale plate, with the third plate having the properly placed transparent windows labeled for the appropriate values or solutions. Further extension of this log scale concept is accomplished by addition of more rotating transparent plates above the base plate and the initial log scale plate, each containing their own log scales for pursuing more extensive solutions and represented by a chain of multiplications or divisions.

Linear scales for addition and subtraction. The concepts represented by section 10(D) above for division and multiplication of medical or obstetrical information can be applied to other medical or obstetrical problems requiring addition or subtraction. This is accomplished by using linear scales instead of log scales. An example would be the addition of Apgar score components after delivery of a baby. Various points are awarded for different clinical situations, with the range of zero to two points for each of five clinical factors such as respiration rate and muscle tone. Each of these point scores are added to reach a final Apgar score which describes the overall general condition of the baby. Rapid addition of scores is accomplished by aligning two identical linear scales sequentially until the final solution number is displayed. Use of separate transparent windows to individually display each numeric entry and solution can improve the ease of use of this device in a manner identical to that described above for log scales.

This concept can be further extended to allow addition or subtraction of exponents.

A fully functional circular slide rule for general multiplication and division using log scales for mantissa and linear scales for exponential notations can be constructed in this manner, with overlying windows improving the ease of use of this analog device.

Customized scales for algorithms. The use of sliding log scales is not restricted to simple multiplication and division. By modification of the two adjacent sliding log scales via compression or expansion, many basic mathematical solutions can be obtained for specific algorithms. For instance, a customized log scale for patient weight adjacent to a customized log scale for patient height can be used to derive a solution for body mass index. Different customization of height and weight scales using a different algorithm can yield a solution for body surface area. Several prior art devices are available using linear or circular slide rules with these customized scales in order to provide technicians, scientists, and medical personnel with means to rapidly calculate body mass index, surface area, kidney creatinine clearance, and a number of other specific solutions. By printing these customized scales on the back side of an obstetrical calculator, this additional valuable information would be provided by a single device. If the length of the log scales is kept within a certain range, two or more different algorithms can be solved with a "back side" calculator, with the different zones on the surface of the calculator corresponding to different algorithms.

This device can be further enhanced by placing a third rotating plate above the base plate and the custom logarithm plate, containing windows with marked center lines to obscure extraneous data and to allow easy labeling of the measurement data and solution data.

Extended radius of base plate. Because the gestational calculation wheel is based upon a 365-day annual calendar printed along the circumference of a circle, the natural shape of this device is circular. All the functions described above, including the functions on the back side of the calculator, are performed with rotation of circular plates in relation to each other around a common fulcrum at the center. Although the calendar is printed in a circle, the outer shape of the calculator beyond the calendar has no restriction. More surface area can be added to the base plate of the calculator beyond the calendar in any direction, and some prior art devices have an outer shape of a square or rectangle to allow additional information to be printed outside the calendar circle. All the prior art devices have promotional, advertising, or basic medical table items printed outside the calendar, but additional surface area added in this range can be used to actively calculate solutions or align information by also extending the rotating plates. This allows movement of a transparent upper plate with center lines or scales printed on its surface to move over the corresponding information on the extended part of the base plate below. For instance, additional scales for correlating maternal age with prenatal mortality can be printed on parallel arcs, and the upper transparent plate can contain a center line which will align the information for the user to view. This concept can be extended to logarithmic scales, linear scales, or custom algorithm scales printed over the extended area, or to rotating algorithm solution windows or slot windows to provide the other functions described above.

Because it may be unfeasible to extend the entire circumference of the calculating device equal in all directions due to size or space considerations, such as making the calculator small enough to fit into a lab coat pocket, the extended radius of the base plate and associated transparent rotating plates can be limited to one direction or a specific arc length along the circumference.

If a "Z" solution log scale is included on the extended portion of the plate, this would allow more room on the center circular portion of the calculator for the entry regions for the "X" and "Y" rotating scales or windows. Because a smaller arc length is included in the extended part of the plate, this method would be best reserved for algorithmic solutions that lie within a specific range that can be included within that arc length. For instance, nearly all clinical values of the FL/AC ratio lie between 0.13 and 0.32, with a normal range lying between 0.20 and 0.24. Because this range encompasses only a relatively small segment of the logarithmic scale, it could be printed on an extended portion of the base plate which encompasses less than one-third of the circumference of the circle. This would allow construction of a circular gestation wheel device with extended calculation capacity to still fit within a lab coat pocket without changing the maximum radius of the actual calculating circle. Alternately, active promotional devices can also be included on the limited extended portion, for instance pixel alignment schemes for marketing or advertising.

Other Calendars printed on the back side. Many medical and technical applications use calendars of different lengths, and these other calendars can be printed on the back side of the gestation calculation wheel.

For applications requiring extremely precise alignments accurate to within one day, the gestational calculator would become inaccurate after the end of February every fourth year during leap years. A separate nearly identical calculator containing 366 days with a 29-day February can be printed on the back side of the original calculator to be used only during leap years for these applications. This arrangement would be especially useful for accurate alignment of the weekday scale for a pregnancy that overlaps February 29.

Exchangeable rotating plates. The cycle day and ovulation plates can be removed and replaced by other plates which correspond to different series of tests or treatments for other medical applications. The same can be done for the front side of the gestational calculation wheel, to add or subtract plates that have different clinical measurements. For instance, the rotating gestational age plate containing information for BPD and femur length can be removed and replaced by another plate containing information for abdominal circumference and head circumference.

It is important to note that all of the embodiments of information and wheel calculators for the back side of the advanced gestational wheel calculators could exist alone as the front side of separate gestational wheel calculators.

Assembly of the Wheels

Figure 8:
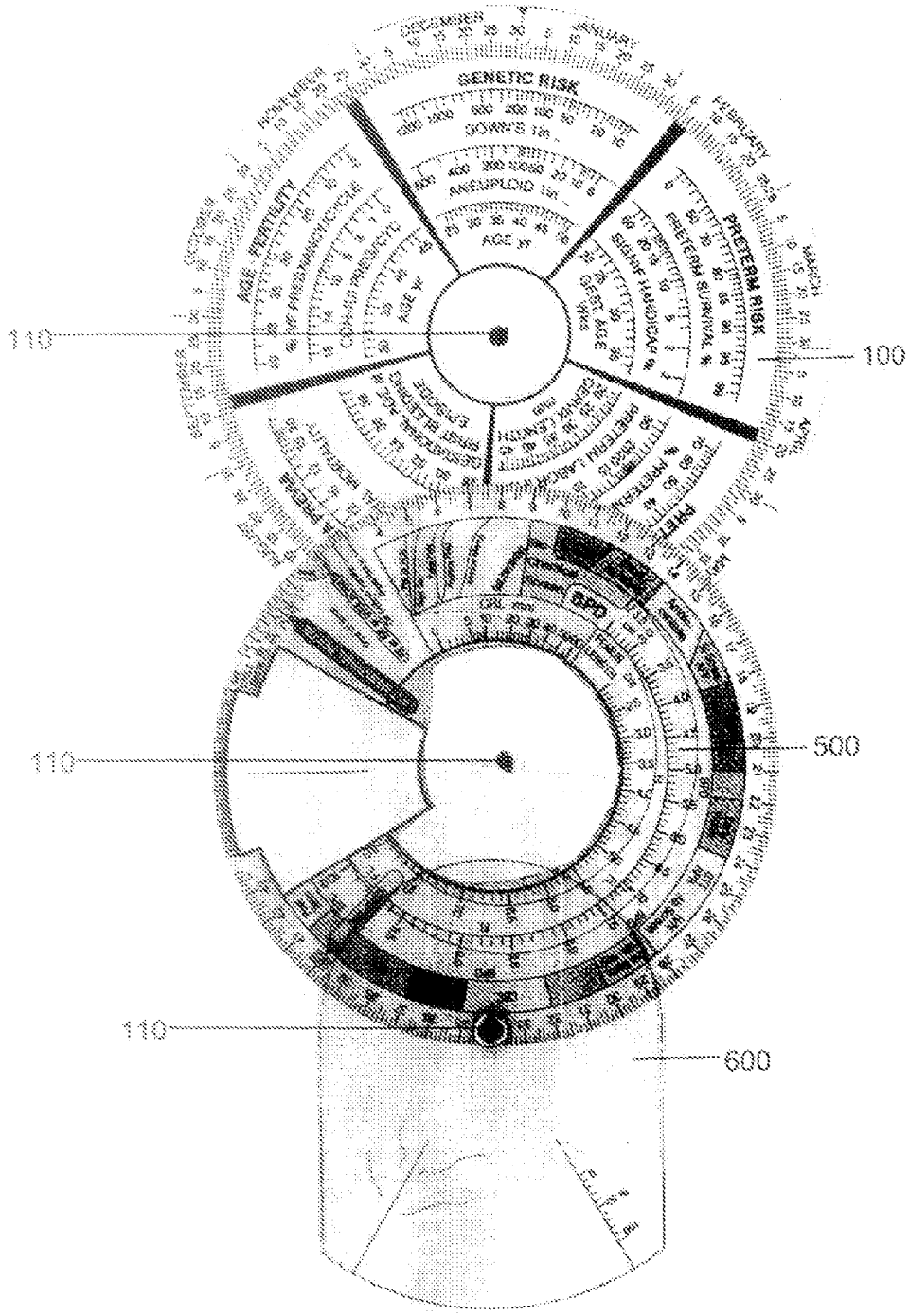
FIG. 8: shows the three different plates from the front side of one embodiment of an advanced gestational wheel calculator.

FIG. 8 illustrates how the "front side" of the wheel of one embodiment of the current invention is assembled. The transparent marker plate 600 is placed on top of the gestational plate 500 which is placed on top of the calendar plate 100. All three plates are connected and rotate about axis 110.

Figure 8B:
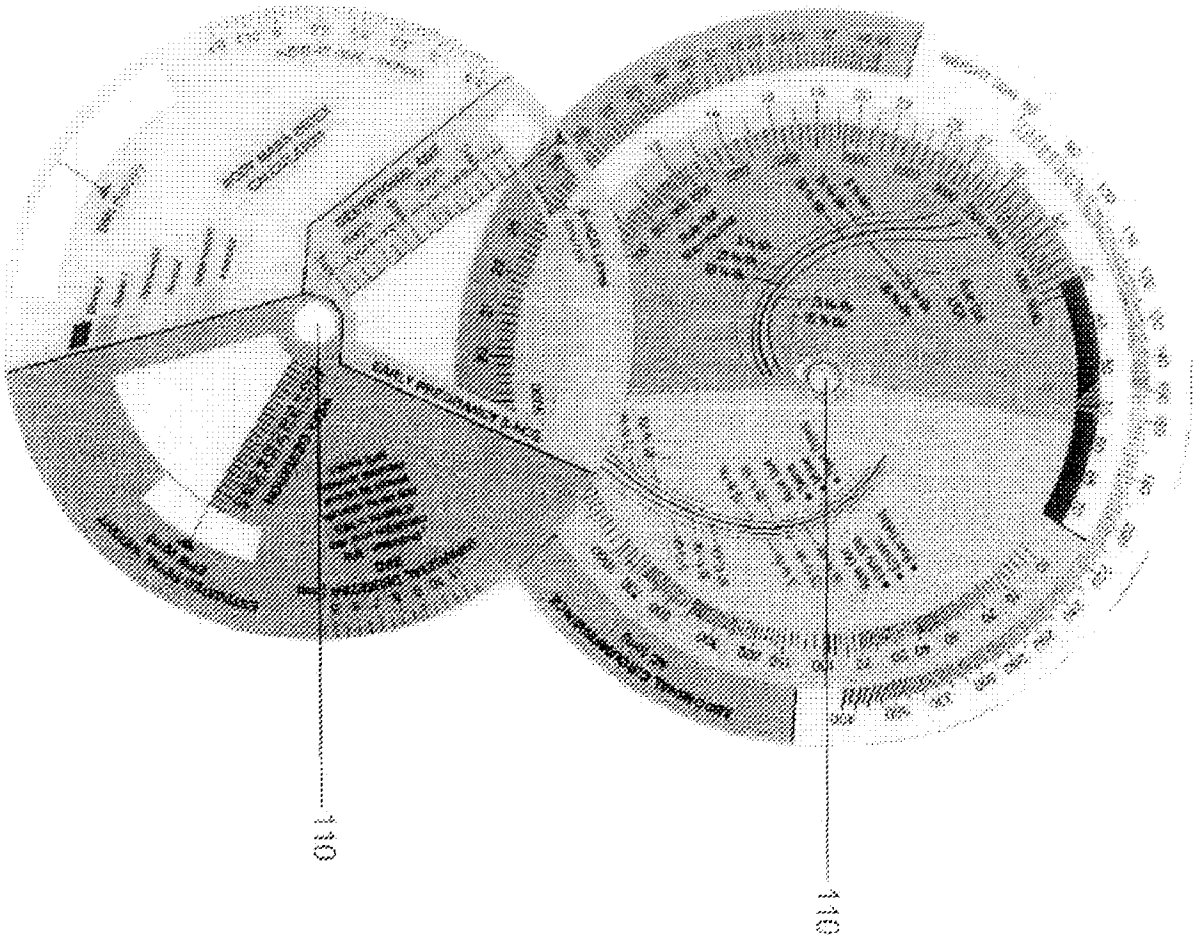
FIG. 8B: shows the two different plates from the back side of one embodiment of an advanced gestational wheel calculator.

FIG. 8B illustrates how the "back side" of the wheel of one embodiment of the current invention is assembled.

The Rear Face of the Wheel

Figure 19:
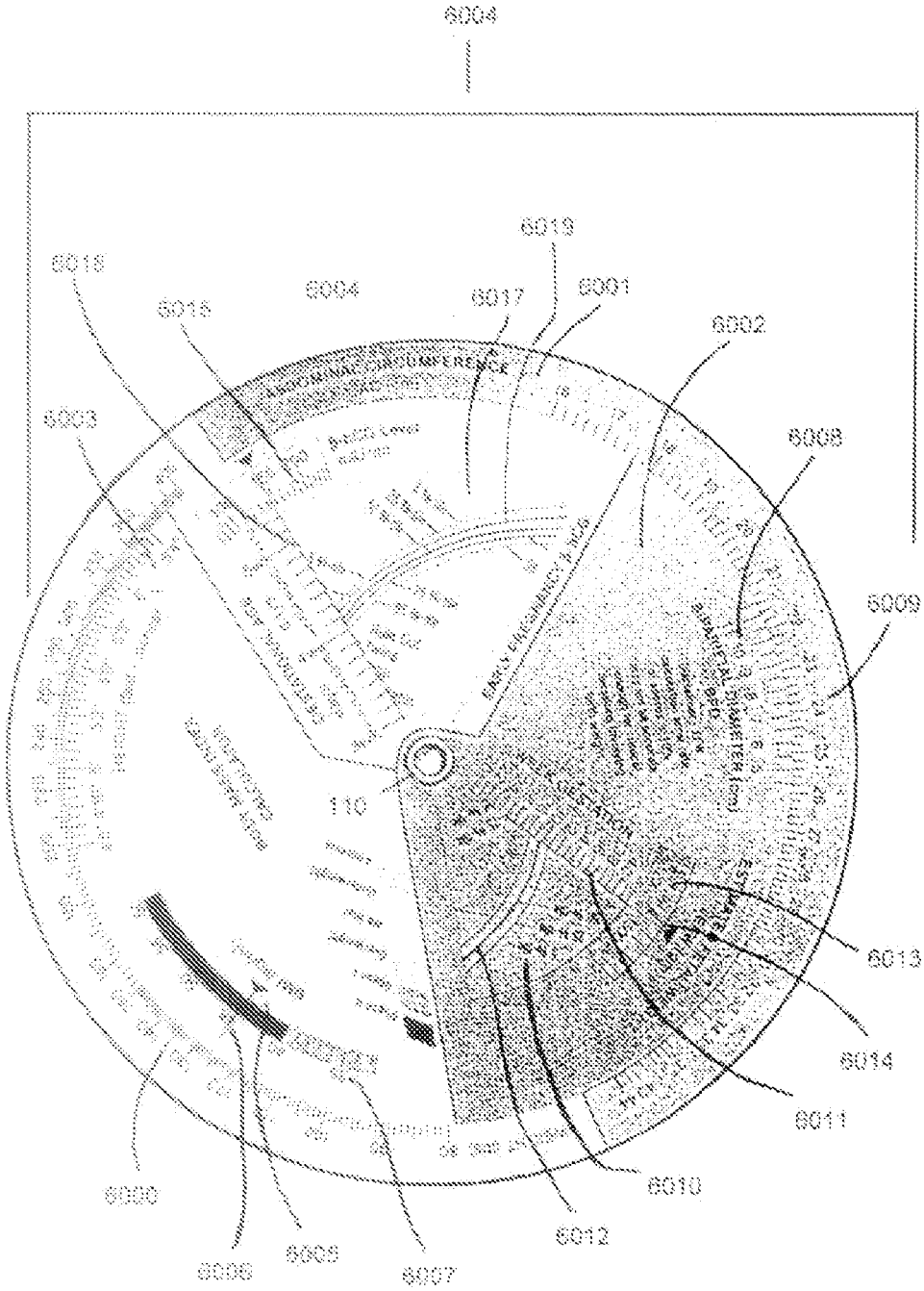
FIG. 19 shows a rear face of a wheel according to the invention.

FIG. 19 shows a rear face of a wheel 6004 according to the invention. A first scale 6000 is on a first plate 6001. This first scale 6000 is circular, and bears markings indicative of a weight of a patient, the markings disposed in logarithmic spacing. A second plate 6002 is in rotatable relation to the first plate 6001, rotating about pivot point 110. The second plate 6002 bears a second circular scale 6003, the second scale 6003 bearing markings indicative of the height of the patient, the markings disposed in logarithmic spacing.

Figure 20:
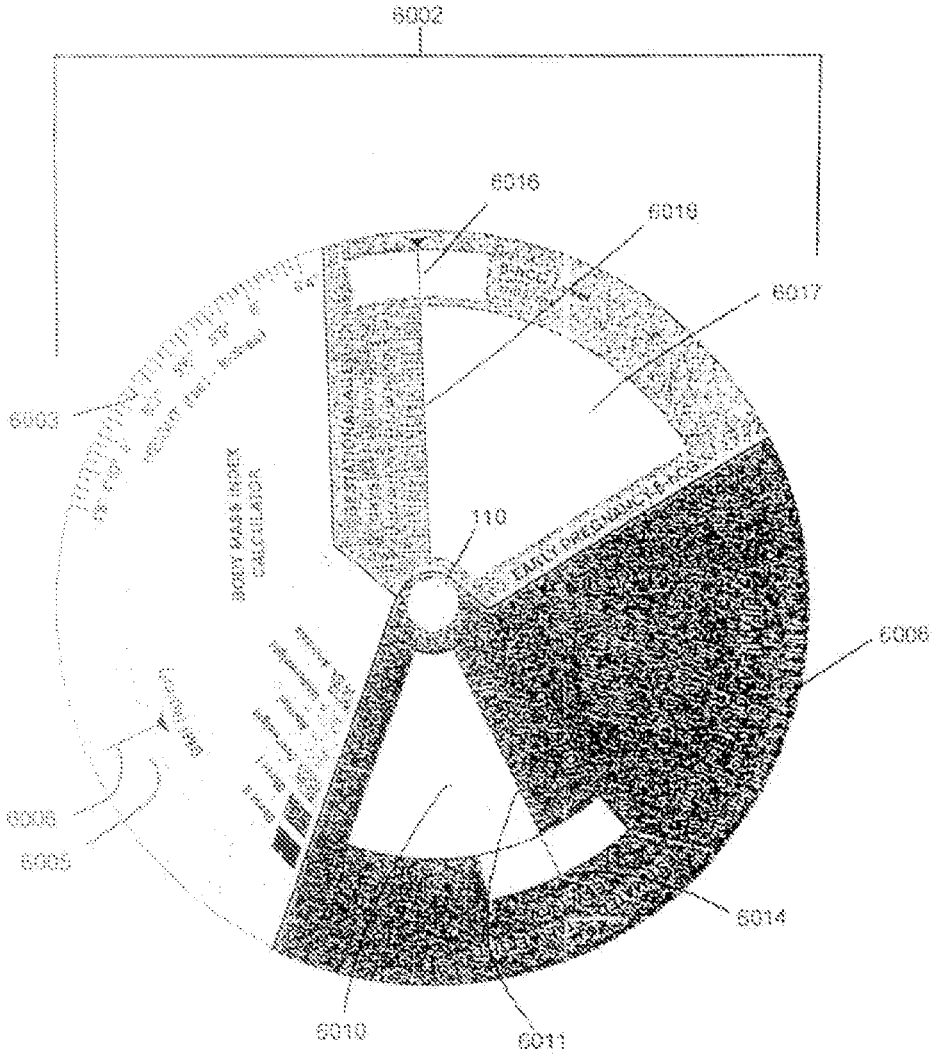
FIGS. 20 and 21 show, respectively, second and first plates of the wheel of FIG. 19.
Figure 21:
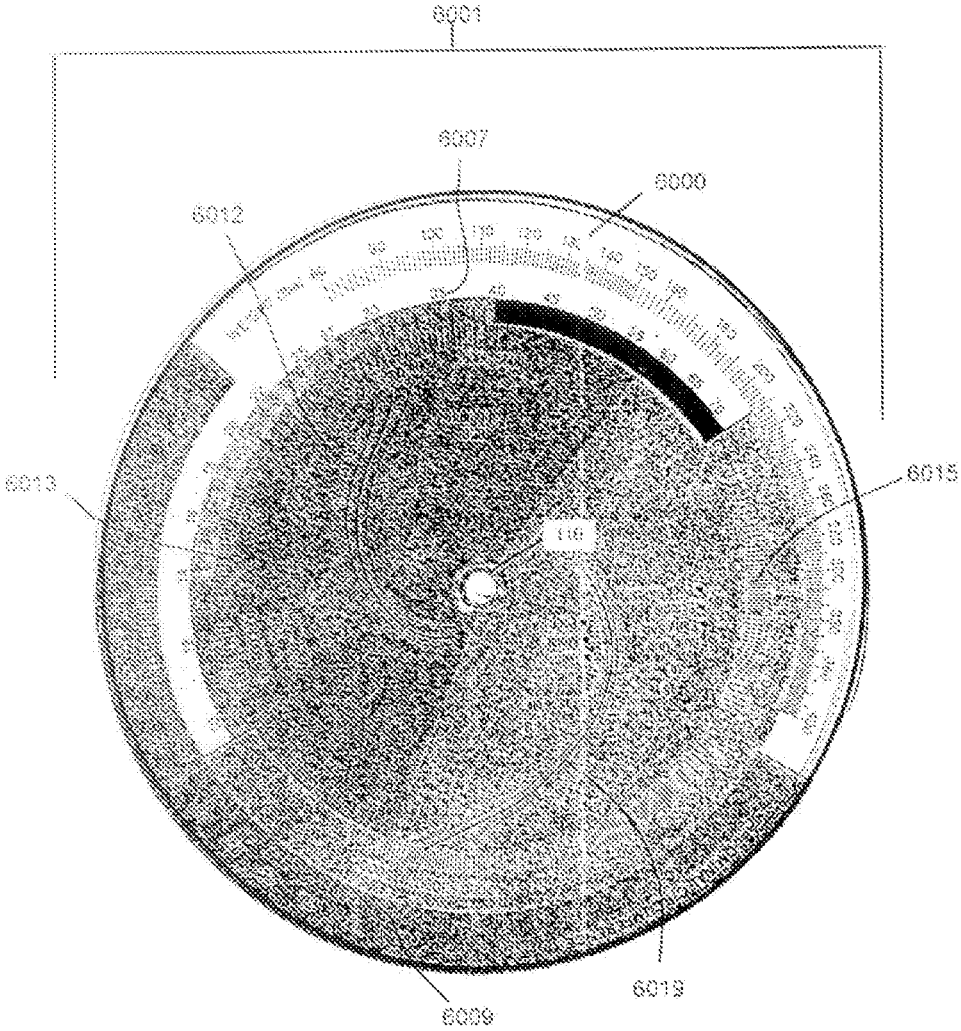

The second plate 6002 further comprises a window 6005 and a marker 6006, all of which may be seen in FIGS. 19 and 20. FIG. 20 shows the second plate 6002 of the wheel 6004 of FIG. 19. The first plate 6001 further comprises a third scale 6007 bearing markings indicative of body mass index, the markings disposed in logarithmic spacing, all of which may be seen in FIGS. 19 and 21. FIG. 21 shows the first plate 6001 of the wheel 6004 of FIG. 19. It will be seen that alignment of a marking on the first scale 6000 and a marking on the second scale 6003 achieves a juxtaposition of the marker 6006 with a marking of the third scale 6007. The use of logarithmic scales brings about a calculation of a ratio between the height and weight, thereby arriving at a body-mass index.

It will be appreciated that the height could be on the second plate 6002 and the weight on the first plate 6001, or the other way around, without departing from the invention.

Returning to FIG. 19, the first plate 6001 bears a first circular scale 6009 bearing first markings indicative of an abdominal circumference of a fetus, the markings disposed in logarithmic spacing. This may also be seen in FIG. 21. A second plate 6002 is in rotatable relation to the first plate 6001. The second plate 6002 bears a second circular scale

6008, bearing second markings indicative of the biparietal diameter of the fetus, the markings disposed in logarithmic spacing. The second plate 6008 further comprises a window 6010 and scale 6011 extending radially, the scale 6011 bearing third markings indicative of a duration of gestation of the fetus. The first plate 6001 further comprises a region bearing traces 6012 indicative of percentile distribution at the scale of various durations of gestation of the fetus. Alignment of a marking on the first scale 6009 and a marking on the second scale 6008 achieves a juxtaposition of the third scale 6011 with the traces 6012 of the region.

The first plate 6001 further comprises a fourth scale 6013 bearing fourth markings indicative of estimated fetal weight of the fetus, the fourth markings in logarithmic spacing. The second plate further comprises a marker 6014. The alignment of the marking on the first scale 6009 and the marking on the second scale 6008 further achieves a juxtaposition of the marker 6014 with the markings of the fourth scale 6013.

It will be appreciated that the biparietal diameter could be on the second plate 6002 and the abdominal circumference on the first plate 6001, or the other way around, without departing from the invention.

Returning to FIG. 19, the first plate 6001 also bears a first circular scale 6015, the first scale 6015 bearing first markings indicative of a level of beta-hCG. This may also be seen in FIG. 21. The second plate 6002 bears a cursor 6016, and further comprises a window 6017 and a second scale 6018 extending radially, the second scale 6018 bearing second markings indicative of a gestational age of a fetus. The first plate 6001 further comprises a region bearing traces 6019 indicative of percentile distribution at the scale of various gestational ages of the fetus. In this way, alignment of a marking on the first scale 6015 and the cursor 6016 achieves a juxtaposition of the second scale 6018 with the traces 6019 of the region.

It will be appreciated that although the radial scales 6011 and 6018 are illustrated as extending straight out from the pivot 110, the scales could possibly extend from the pivot 110 outwards to the circumference of the wheel 6004 along a non-straight path without departing from the invention, so long as the traces 6012 and 6019 were reshaped to match the path of the radial scales 6011 and 6018. Thus the term "radial" here encompasses extension outwards from the pivot 110, and in a preferred embodiment will extend straight outwards.

Those skilled in the art will have no difficulty devising myriad obvious improvements and variations of the invention, all of which are intended to be encompassed within the claims which follow.

The invention claimed is:

1. A gestational wheel calculator comprising:

a plurality of plates joined together at and rotating about a common axis, to bring written notations on the plates into meaningful juxtaposition to provide gestational information, said written notations including:

a calendar plate rotating on the axis comprising a calendar, said calendar comprising:

at least nine and not greater than twelve segments, each segment corresponding to a respective calendar month, each segment comprising at least one and not greater than thirty-one marks corresponding to particular calendar days for its respective month, each mark spaced from adjacent marks by a predetermined angle with respect to the axis, for each segment a mark defining a first mark and other marks, each mark having an appearance, said appearance of the first mark being noticeably different from the appearance of the other marks of the particular segment;

a second plate rotating on the axis comprising:

marks spaced apart by the predetermined angle and labeled with numbers in a range of twenty to forty-five;

an intercourse timing calculator comprising:

a sperm life plate rotating on the axis comprising:

a marker for marking a corresponding date on the calendar plate, said date representing a date upon which intercourse occurred, and a sperm survival probability curve;

an egg life plate rotating on the axis comprising:

a marker for marking a corresponding date on the calendar plate, said date representing a date upon which ovulation occurred, and an egg survival probability curve;

wherein one of the sperm life plate and the egg life plate is transparent and is superposed upon the other and wherein the sperm life plate and the egg life plate rotate relative to each other about the axis;

a gestational age, ultrasound landmark probability, and ultrasound medical pregnancy test measurement scale plate, said plate rotating on the axis, said plate comprising:

day markers, each day marker spaced from adjacent day markers by a predetermined angle with respect to the axis, wherein each day marker indicates gestational age in days, weekly sub-markers, each weekly sub-marker spaced from adjacent weekly sub-markers by a predetermined angle with respect to the axis, wherein each weekly sub-marker indicates gestational age in weeks, wherein each weekly sub-marker's appearance is noticeably different than that of each day marker's appearance, gestational ultrasound landmark probability curves, each curve representing a probability for ultrasound visualization of fetal development landmarks, each curve further characterized in that it is located at a predetermined angle with respect to the axis gestational ultrasound medical pregnancy test measurement scales, each scale comprising marks, each mark positioned at a predetermined angle with respect to the axis, each mark further characterized in that the mark corresponds to ultrasound measurements or test results during a pregnancy which are continuous variables dependent on corresponding gestational ages.

2. The gestational wheel calculator of claim 1 further comprising a transparent marker arm plate rotating about the axis.

3. The gestational wheel calculator of claim 1 further comprising a quarter year window located on the gestational age, ultrasound landmark probability, and ultrasound medical pregnancy test measurement scale plate.

4. The gestational wheel calculator of claim 1 further comprising plates on a second back side of said gestational wheel calculator said plates rotating about the axis.

5. An intercourse timing calculator comprising:

a sperm life plate rotating about an axis comprising:

a marker for marking a corresponding date on the calendar plate, said date representing a date upon which intercourse occurred, and a sperm survival probability curve;

an egg life plate rotating about the axis comprising:

a marker for marking a corresponding date on the calendar plate, said date representing a date upon which ovulation occurred, and an egg survival probability curve wherein one of the sperm life plate and the egg life plate is transparent and is superposed upon the other and wherein the sperm life plate and the egg life plate rotate relative to each other about the axis.

6. A gestational age, ultrasound landmark probability, and ultrasound medical pregnancy test measurement scale comprising:

day markers, each day marker spaced from adjacent day markers by a predetermined angle with respect to the axis, wherein each day marker indicates gestational age in days, weekly sub-markers, each weekly sub-marker spaced from adjacent weekly sub-markers by a predetermined angle with respect to the axis, wherein each weekly sub-marker indicates gestational age in weeks, wherein each weekly sub-marker's appearance is noticeably different than that of each day marker's appearance, gestational ultrasound landmark probability curves, each curve representing a probability for ultrasound visualization of fetal development landmarks, each curve further characterized in that it located at a predetermined angle with respect to the axis gestational ultrasound medical pregnancy test measurement scales, each scale comprising marks, each mark positioned at a predetermined angle with respect to the axis, each mark further characterized in that the mark corresponds to ultrasound measurements or test results during a pregnancy which are continuous variables dependent on corresponding gestational ages.

7. A gestational wheel calculator comprising:

a plurality of plates joined together at and rotating about a common axis, to bring written notations on the plates into meaningful juxtaposition to provide gestational information, said written notations including:

a calendar plate rotating on an axis comprising a calendar, said calendar comprising:

at least nine and not greater than twelve segments, each segment corresponding to a respective calendar month, each segment comprising at least one and not greater than thirty-one marks corresponding to particular calendar days for its respective month, each mark spaced from adjacent marks by a predetermined angle with respect to the axis, for each segment a mark defining a first mark and other marks, each mark having an appearance, said appearance of the first mark being noticeably different from the appearance of the other marks of the particular segment;

a second plate rotating on the axis comprising:

marks spaced apart by the predetermined angle and labeled with numbers in a range of twenty to forty-five;

an intercourse timing calculator comprising:

a sperm life plate rotating on the axis comprising:

a marker for marking a corresponding date on the calendar plate, said date representing a date upon which intercourse occurred, and a sperm survival probability curve;

an egg life plate rotating on the axis comprising:

a marker for marking a corresponding date on the calendar plate, said date representing a date upon which ovulation occurred, and an egg survival probability curve;

wherein one of the sperm life plate and the egg life plate is transparent and is superposed upon the other and wherein the sperm life plate and the egg life plate rotate relative to each other about the axis.

8. A gestational wheel calculator comprising:

a plurality of plates joined together at and rotating about a common axis, to bring written notations on the plates into meaningful juxtaposition to provide gestational information, said written notations including:

a calendar plate rotating on an axis comprising a calendar, said calendar comprising:

at least nine and not greater than twelve segments, each segment corresponding to a respective calendar month, each segment comprising at least one and not greater than thirty-one marks corresponding to particular calendar days for its respective month, each mark spaced from adjacent marks by a predetermined angle with respect to the axis, for each segment a mark defining a first mark and other marks, each mark having an appearance, said appearance of the first mark being noticeably different from the appearance of the other marks of the particular segment;

a second plate rotating on the axis comprising:

marks spaced apart by the predetermined angle and labeled with numbers in a range of twenty to forty-five;

a gestational age, ultrasound landmark probability, and ultrasound medical pregnancy test measurement scale plate, said plate rotating on the axis, said plate comprising:

day markers, each day marker spaced from adjacent day markers by a predetermined angle with respect to the axis, wherein each day marker indicates gestational age in days, weekly sub-markers, each weekly sub-marker spaced from adjacent weekly sub-markers by a predetermined angle with respect to the axis, wherein each weekly sub-marker indicates gestational age in weeks, wherein each weekly sub-marker's appearance is noticeably different than that of each day marker's appearance, gestational ultrasound landmark probability curves, each curve representing a probability for ultrasound visualization of fetal development landmarks, each curve further characterized in that it located at a predetermined angle with respect to the axis gestational ultrasound medical pregnancy test measurement scales, each scale comprising marks, each mark positioned at a predetermined angle with respect to the axis, each mark further characterized in that the mark corresponds to ultrasound measurements or test results during a pregnancy which are continuous variables dependent on corresponding gestational ages.

9. A gestational wheel calculator comprising a plurality of plates joined together at and rotating about a common axis, to bring written notations on the plates into meaningful juxtaposition to provide gestational information, said written notations including:

a calendar plate rotating on an axis comprising a calendar, said calendar comprising:

at least nine and not greater than twelve segments, each segment corresponding to a respective calendar month, each segment comprising at least one and not greater than thirty-one marks corresponding to particular calendar days for its respective month, each mark spaced from adjacent marks by a predetermined angle with respect to the axis, for each segment a mark defining a first mark and other marks, each mark having an appearance, said appearance of the first mark being noticeably different from the appearance of the other marks of the particular segment;

a second plate rotating on the axis comprising:

marks spaced apart by the predetermined angle and labeled with numbers in a range of twenty to forty-five;

an intercourse timing calculator comprising:

a sperm life plate rotating on the axis comprising:

a marker for marking a corresponding date on the calendar plate, said date representing a date upon which intercourse occurred, and a sperm survival probability curve;

an egg life plate rotating on the axis comprising:

a marker for marking a corresponding date on the calendar plate, said date representing a date upon which ovulation occurred, and an egg survival probability curve;

wherein one of the sperm life plate and the egg life plate is transparent and is superposed upon the other and wherein the sperm life plate and the egg life plate rotate relative to each other about the axis;

a gestational age and ultrasound landmark probability scale plate, said plate rotating on the axis, said plate comprising:

day markers, each day marker spaced from adjacent day markers by a predetermined angle with respect to the axis, wherein each day marker indicates gestational age in days, weekly sub-markers, each weekly sub-marker spaced from adjacent weekly sub-markers by a predetermined angle with respect to the axis, wherein each weekly sub-marker indicates gestational age in weeks, wherein each weekly sub-marker's appearance is noticeably different than that of each day marker's appearance, and gestational ultrasound landmark probability curves, each curve representing a probability for ultrasound visualization of fetal development landmarks, each curve further characterized in that it located at a predetermined angle with respect to the axis.

10. A gestational wheel calculator comprising a plurality of plates joined together at and rotating about a common axis, to bring written notations on the plates into meaningful juxtaposition to provide gestational information, said written notations including:

a calendar plate rotating on an axis comprising a calendar, said calendar comprising:

at least nine and not greater than twelve segments, each segment corresponding to a respective calendar month, each segment comprising at least one and not greater than thirty-one marks corresponding to particular calendar days for its respective month, each mark spaced from adjacent marks by a predetermined angle with respect to the axis, for each segment a mark defining a first mark and other marks, each mark having an appearance, said appearance of the first mark being noticeably different from the appearance of the other marks of the particular segment;

a second plate rotating on the axis comprising:

marks spaced apart by the predetermined angle and labeled with numbers in a range of twenty to forty-five;

an intercourse timing calculator comprising:

a sperm life plate rotating on the axis comprising:

a marker for marking a corresponding date on the calendar plate, said date representing a date upon which intercourse occurred, and a sperm survival probability curve;

an egg life plate rotating on the axis comprising:

a marker for marking a corresponding date on the calendar plate, said date representing a date upon which ovulation occurred, and an egg survival probability curve;

wherein one of the sperm life plate and the egg life plate is transparent and is superposed upon the other and wherein the sperm life plate and the egg life plate rotate relative to each other about the axis;

a gestational age, and ultrasound medical pregnancy test measurement scale plate, said plate rotating on the axis, said plate comprising:

day markers, each day marker spaced from adjacent day markers by a predetermined angle with respect to the axis, wherein each day marker indicates gestational age in days, weekly sub-markers, each weekly sub-marker spaced from adjacent weekly sub-markers by a predetermined angle with respect to the axis, wherein each weekly sub-marker indicates gestational age in weeks, wherein each weekly sub-marker's appearance is noticeably different than that of each day marker's appearance, and gestational ultrasound medical pregnancy test measurement scales, each scale comprising marks, each mark positioned at a predetermined angle with respect to the axis, each mark further characterized in that the mark corresponds to ultrasound measurements or test results during a pregnancy which are continuous variables dependent on corresponding gestational ages.

11. A pre-term delivery risk wheel calculator comprising two plates rotating about a common axis, said plates including:

a first transparent plate including an indicator superimposed upon a radius of said transparent plate, a second plate, comprising a series of scales, each scale including markers, each marker spaced from adjacent markers by a predetermined angle with respect to the axis, said series of scales including:

a first scale wherein the markers represent gestational age, a second scale wherein the markers represent risk of significant handicap upon delivery at a corresponding gestational age, and a third scale wherein the markers represent a percent calculation of likelihood of fetus survival upon delivery at a corresponding gestational age.

12. A pre-term delivery risk wheel calculator comprising two plates rotating about a common axis, said plates including:

a first transparent plate including an indicator superimposed upon a radius of said transparent plate, a second plate, comprising a series of scales, each scale including markers, each marker spaced from adjacent markers by a predetermined angle with respect to the axis, said series of scales including:

a first scale wherein the markers represent cervix length, and a second scale wherein the markers represent risk of preterm labor corresponding to a particular cervix length.

13. A likelihood of ongoing pregnancy wheel calculator comprising two plates rotating about a common axis, said plates including:

first transparent plate including an indicator superimposed upon a radius of said transparent plate, a second plate, comprising a series of scales, each scale including markers, each marker spaced from adjacent markers by a predetermined angle with respect to the axis, said series of scales including:

a first scale wherein the markers represent the serum β-hCG level at a predetermined gestational age, said-hCG level ranging from 0 to 1000, a second scale wherein the markers represent a percent likelihood of ongoing pregnancy for an expecting mother under an age of forty years, and a third scale wherein the markers represent a percent likelihood of ongoing pregnancy for an expecting mother over an age of forty years.

14. A likelihood of fertility wheel calculator comprising two plates rotating about a common axis, said plates including:

a first transparent plate including an indicator superimposed upon a radius of said transparent plate, a second plate, comprising a series of scales, each scale including markers, each marker spaced from adjacent markers by a predetermined angle with respect to the axis, said series of scales including:

a first scale wherein the markers represent the percent likelihood of IVF pregnancy per cycle, a second scale wherein the markers represent a percent likelihood of COH-IUI pregnancy per cycle, and a third scale wherein the markers represent an age of a female patent ranging from 30 to 45 years.

15. A genetic risk wheel calculator comprising two plates rotating about a common axis, said plates including:

a first transparent plate including an indicator superimposed upon a radius of said transparent plate, a second plate, comprising a series of scales, each scale including markers, each marker spaced from adjacent markers by a predetermined angle with respect to the axis, said series of scales including:

a first scale wherein the markers represent a likelihood of Down's syndrome corresponding to a particular age of a mother, a second scale wherein the markers represent a likelihood of Aneuploidy corresponding to a particular age of a mother, and a third scale wherein the markers represent an age of a mother, said age ranging from 25 to 50 years.

16. A wheel comprising:

a first scale marked with evenly spaced dates with a first spacing of a first angular extent, the dates spanning at least nine months;

a second scale in rotatable juxtaposition with the first scale, the second scale marked with landmarks of interest with respect to a human gestation process;

the second scale having a region marked with a plurality of second markings spaced with an even spacing matching the first spacing;

the second markings marked for a range of lengths of menstrual cycle;

whereby alignment of one of the second markings, selected for a length of menstrual cycle of a particular patient, with a date on the first scale, permits determination of dates for the landmarks of interest.

17. A method for use with a wheel, the wheel comprising a first scale marked with evenly spaced dates with a first spacing of a first angular extent, the dates spanning at least nine months; a second scale in rotatable juxtaposition with the first scale, the second scale marked with landmarks of interest with respect to a human gestation process; the second scale having a region marked with a plurality of second markings spaced with an even spacing matching the first spacing; the second markings marked for a range of lengths of menstrual cycle; the method comprising the steps of:

aligning one of the second markings, selected for a length of menstrual cycle of a particular patient, with a date on the first scale; the alignment permitting determination of dates for the landmarks of interest.

18. A wheel comprising:

a first scale marked with evenly spaced dates with a first spacing of a first angular extent, the dates spanning at least nine months;

a second scale in rotatable juxtaposition with the first scale, the second scale marked with landmarks of interest with respect to a human gestation process;

a third plate atop the second scale and rotatable with respect to the second scale, the third plate transparent in part of its area, the third plate having radial cursor alignable with selected ones of the landmarks of interest and with selected ones of the dates of the first scale;

the third plate having an opaque area defining a first pattern;

the second scale further comprising an opaque area defining a second pattern; the first pattern and second pattern disposed, when the third plate is in a particular position relative to the second scale, to reveal as recognizable a hitherto unrecognizable message.

19. A method for use with a wheel, the wheel comprising a first scale marked with evenly spaced dates with a first spacing of a first angular extent, the dates spanning at least nine months; a second scale in rotatable juxtaposition with the first scale, the second scale marked with landmarks of interest with respect to a human gestation process; a third plate atop the second scale and rotatable with respect to the second scale, the third plate transparent in part of its area, the third plate having radial cursor alignable with selected ones of the landmarks of interest and with selected ones of the dates of the first scale; the third plate having an opaque area defining a first pattern; the second scale further comprising an opaque area defining a second pattern; the method comprising the step of:

rotating the third plate into a particular position relative to the second scale, to reveal as recognizable a hitherto unrecognizable message.

20. A wheel comprising:

a first plate bearing a first circular scale, the first scale bearing markings indicative of one of a height or a weight of a patient, the markings disposed in logarithmic spacing;

a second plate in rotatable relation to the first plate, the second plate bearing a second circular scale, the second scale bearing markings indicative of another of the height or the weight of the patient, the markings disposed in logarithmic spacing;

the second plate further comprising a window and marker;

the first plate further comprising a third scale bearing markings indicative of body mass index, the markings disposed in logarithmic spacing;

whereby alignment of a marking on the first scale and a marking on the second scale achieves a juxtaposition of the marker with a marking of the third scale.

21. A method for use with a wheel, the wheel comprising a first plate bearing a first circular scale, the first scale bearing markings indicative of one of a height or a weight of a patient, the markings disposed in logarithmic spacing; a second plate in rotatable relation to the first plate, the second plate bearing a second circular scale, the second scale bearing markings indicative of another of the height or the weight of the patient, the markings disposed in logarithmic spacing; the second plate further comprising a window and marker; the first plate further comprising a third scale bearing markings indicative of body mass index; the method comprising:

aligning a marking on the first scale and a marking on the second scale, thereby achieving a juxtaposition of the marker with a marking of the third scale.

22. A wheel comprising: a first plate bearing a first circular scale, the first scale bearing first markings indicative of one of a biparietal diameter or an abdominal circumference of a fetus, the markings disposed in logarithmic spacing; a second plate in rotatable relation to the first plate, the second plate bearing a second circular scale, the second scale bearing second markings indicative of another of the biparietal diameter or the abdominal circumference of the fetus, the markings disposed in logarithmic spacing; the second plate further comprising a window and scale extending radially, the scale bearing third markings indicative of a duration of gestation of the fetus; the first plate further comprising a region bearing traces indicative of percentile distribution at the scale of various durations of gestation of the fetus; whereby alignment of a marking on the first scale and a marking on the second scale achieves a juxtaposition of the third scale with the traces of the region.

23. The wheel of claim 22 wherein: the first plate further comprises a fourth scale bearing fourth markings indicative of estimated fetal weight of the fetus, the fourth markings in logarithmic spacing; whereby the alignment of the marking on the first scale and the marking on the second scale further achieves a juxtaposition of the marker with the markings of the fourth scale.

24. A wheel comprising:

a first plate bearing a first circular scale, the first scale bearing first markings indicative of one of a biparietal diameter or an abdominal circumference of a fetus, the markings disposed in logarithmic spacing;

a second plate in rotatable relation to the first plate, the second plate bearing a second circular scale, the second scale bearing second markings indicative of another of the biparietal diameter or the abdominal circumference of the fetus, the second markings disposed in logarithmic spacing;

the second plate further comprising a window and a marker;

the first plate further comprising a third scale bearing third markings indicative of estimated fetal weight of the fetus, the third markings in logarithmic spacing;

whereby alignment of a marking on the first scale and a marking on the second scale achieves a juxtaposition of the marker with the markings of the third scale.

25. The wheel of claim 24 wherein:

the second plate further comprises a window and scale extending radially, the scale bearing fourth markings indicative of a duration of gestation of the fetus;

the first plate further comprising a region bearing traces indicative of percentile distribution at the scale of various durations of gestation of the fetus;

whereby alignment of the marking on the first scale and the marking on the second scale achieves a juxtaposition of the fourth scale with the traces of the region.

26. A method for use with a wheel, the wheel comprising: a first plate bearing a first circular scale, the first scale bearing first markings indicative of one of a biparietal diameter or an abdominal circumference of a fetus, the markings disposed in logarithmic spacing; a second plate in rotatable relation to the first plate, the second plate bearing a second circular scale, the second scale bearing second markings indicative of another of the biparietal diameter or the abdominal circumference of the fetus, the markings disposed in logarithmic spacing; the second plate further comprising a window and scale extending radially, the scale bearing third markings indicative of a duration of gestation of the fetus; the first plate further comprising a region bearing traces indicative of percentile distribution at the scale of various durations of gestation of the fetus; the method comprising:

aligning a marking on the first scale and a marking on the second scale to achieve a juxtaposition of the third scale with the traces of the region.

27. The method of claim 26 wherein: the first plate further comprises a fourth scale bearing fourth markings indicative of estimated fetal weight of the fetus, the fourth markings in logarithmic spacing;

whereby the step of aligning of the marking on the first scale and the marking on the second scale further achieves a juxtaposition of the marker with the markings of the fourth scale.

28. A method for use with a wheel, the wheel comprising: a first plate bearing a first circular scale, the first scale bearing first markings indicative of one of a biparietal diameter or an abdominal circumference of a fetus, the markings disposed in logarithmic spacing; a second plate in rotatable relation to the first plate, the second plate bearing a second circular scale, the second scale bearing second markings indicative of another of the biparietal diameter or the abdominal circumference of the fetus, the second markings disposed in logarithmic spacing; the second plate further comprising a window and a marker; the first plate further comprising a third scale bearing third markings indicative of estimated fetal weight of the fetus, the third markings in logarithmic spacing; the method comprising:

aligning a marking on the first scale and a marking on the second scale, thereby achieving a juxtaposition of the marker with the markings of the third scale.

29. The method of claim 28 wherein: the second plate further comprises a window and scale extending radially, the scale bearing fourth markings indicative of a duration of gestation of the fetus; and the first plate further comprising a region bearing traces indicative of percentile distribution at the scale of various durations of gestation of the fetus;

whereby the step of alignment of the marking on the first scale and the marking on the second scale achieves a juxtaposition of the fourth scale with the traces of the region.

30. A wheel comprising:

a first plate bearing a first circular scale, the first scale bearing first markings indicative of a level of β-hCG;

a second plate in rotatable relation to the first plate, the second plate bearing a cursor, and further comprising a window and a second scale extending radially, the second scale bearing second markings indicative of a gestational age of a fetus;

the first plate further comprising a region bearing traces indicative of percentile distribution at the scale of various gestational ages of the fetus;

whereby alignment of a marking on the first scale and the cursor achieves a juxtaposition of the second scale with the traces of the region.

31. A method for use with a wheel, the wheel comprising: a first plate bearing a first circular scale, the first scale bearing first markings indicative of a level of β-hCG; a second plate in rotatable relation to the first plate, the second plate bearing a cursor, and further comprising a window and a second scale extending radially, the second scale bearing second markings indicative of a gestational age of a fetus; the first plate further comprising a region bearing traces indicative of percentile distribution at the scale of various gestational ages of the fetus; the method comprising:

aligning a marking on the first scale and the cursor, thereby achieving a juxtaposition of the second scale with the traces of the region.

* * * * *

UNITED STATES PATENT AND TRADEMARK OFFICE

CERTIFICATE OF CORRECTION

PATENT NO. : 7,637,418 B2
APPLICATION NO. : 10/553593
DATED : December 29, 2009
INVENTOR(S) : H. Randall Craig It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 489 days.

Signed and Sealed this

Ninth Day of November, 2010

David J. Kappos

David J. Kappos
*Director of the United States Patent and Trademark Office*